US011784418B2

(12) United States Patent
Fabrega Sanchez et al.

(10) Patent No.: US 11,784,418 B2
(45) Date of Patent: Oct. 10, 2023

(54) MULTI-DIRECTIONAL DUAL-POLARIZED ANTENNA SYSTEM

(71) Applicant: QUALCOMM Incorporated, San Diego, CA (US)

(72) Inventors: Jorge Fabrega Sanchez, San Diego, CA (US); Mohammad Ali Tassoudji, San Diego, CA (US); Jeongil Jay Kim, San Diego, CA (US); Kevin Hsi-Huai Wang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 50 days.

(21) Appl. No.: 17/499,808

(22) Filed: Oct. 12, 2021

(65) Prior Publication Data

US 2023/0114757 A1 Apr. 13, 2023

(51) Int. Cl.
*H01Q 21/24* (2006.01)
*H01Q 9/16* (2006.01)
(Continued)

(52) U.S. Cl.
CPC ..... *H01Q 21/24* (2013.01); *H01Q 9/0407* (2013.01); *H01Q 9/16* (2013.01); *H01Q 13/02* (2013.01); *H01Q 21/0093* (2013.01)

(58) Field of Classification Search
CPC ..... H01Q 21/24; H01Q 9/0407; H01Q 9/16; H01Q 13/02; H01Q 21/0093; H02J 50/00; H02J 50/05; H02J 50/10
See application file for complete search history.

(56) References Cited

U.S. PATENT DOCUMENTS 2,825,061 A * 2/1958 Rowland ..... H01Q 21/205 343/866
4,131,896 A * 12/1978 Miller ..... H01Q 9/26 343/815
(Continued)

FOREIGN PATENT DOCUMENTS

CA 2373645 A1 * 9/2002 ..... H01Q 1/521
CA 2772517 A1 * 9/2012 ..... H01Q 9/10
(Continued)

OTHER PUBLICATIONS

International Search Report and Written Opinion—PCT/US2022/042464—ISA/EPO—dated Dec. 2, 2022.

*Primary Examiner* — Dimary S Lopez Cruz
*Assistant Examiner* — Jordan E. DeWitt
(74) *Attorney, Agent, or Firm* — SUNSTEIN LLP/Qualcomm Incorporated

(57) ABSTRACT

An antenna system includes: a first antenna element configured to transduce between second wireless energy and second transmission-line-conducted energy, wherein the first and second wireless energy are of first and second polarizations of the first antenna element and in first and second directions that are different and define a first plane; and a second antenna element configured to transduce between third wireless energy and third transmission-line-conducted energy and between fourth wireless energy and fourth transmission-line-conducted energy, wherein the third and fourth wireless energy are of first and second polarizations of the second antenna element and in third and fourth directions that are different and define a second plane that is substantially orthogonal to the first plane.

20 Claims, 11 Drawing Sheets

(51) Int. Cl.

| | |
|---|---|
| ***H01Q 9/04*** | (2006.01) |
| ***H01Q 21/00*** | (2006.01) |
| ***H01Q 13/02*** | (2006.01) |

(56) References Cited

U.S. PATENT DOCUMENTS

| | | | | |
|---|---|---|---|---|
| 4,180,820 | A * | 12/1979 | Johns | H01Q 21/205 343/890 |
| 4,839,663 | A * | 6/1989 | Kurtz | H01Q 21/245 343/770 |
| 5,686,928 | A * | 11/1997 | Pritchett | H01Q 21/0006 343/815 |
| 6,369,771 | B1 * | 4/2002 | Chiang | H01Q 1/242 343/820 |
| 7,978,144 | B2 * | 7/2011 | Tanabe | H01Q 25/001 343/810 |
| 9,293,809 | B2 * | 3/2016 | Teillet | H01Q 21/061 |
| 9,825,372 | B1 * | 11/2017 | Buckley | H01Q 1/40 |
| 10,027,014 | B2 * | 7/2018 | Kim | H01Q 1/125 |
| 10,084,241 | B1 * | 9/2018 | Jenwatanavet | H01Q 1/48 |
| 10,283,876 | B1 * | 5/2019 | Livadaru | H01Q 15/0086 |
| 10,629,993 | B2 * | 4/2020 | Yang | H01Q 9/16 |
| 11,121,476 | B2 * | 9/2021 | Kim | H01Q 19/10 |
| 2004/0145526 | A1 * | 7/2004 | Puente Baliarda | H01Q 21/28 343/893 |
| 2004/0201542 | A1 * | 10/2004 | Gottl | H01Q 1/42 343/912 |
| 2005/0040994 | A1 * | 2/2005 | Mazoki | G06K 19/07786 343/795 |
| 2007/0117514 | A1 * | 5/2007 | Gainey | H01Q 19/10 455/25 |
| 2007/0126641 | A1 * | 6/2007 | Saily | H01Q 9/0457 343/700 MS |
| 2007/0241984 | A1 * | 10/2007 | Schadler | H01Q 1/246 343/810 |
| 2008/0079647 | A1 * | 4/2008 | Schadler | H01Q 21/205 343/810 |
| 2008/0291105 | A1 * | 11/2008 | Schadler | H01Q 21/08 343/793 |
| 2009/0009399 | A1 * | 1/2009 | Gaucher | H01Q 21/0075 343/700 MS |
| 2010/0141530 | A1 * | 6/2010 | McMahon | H01Q 5/378 342/417 |
| 2013/0050056 | A1 * | 2/2013 | Lee | H01Q 3/30 343/893 |
| 2013/0214046 | A1 * | 8/2013 | Choi | H01Q 21/24 343/810 |
| 2013/0300602 | A1 * | 11/2013 | Zhou | H01Q 21/245 342/372 |
| 2014/0022131 | A1 * | 1/2014 | Azulay | H01Q 1/007 343/727 |
| 2014/0184457 | A1 * | 7/2014 | Lea | H01Q 21/0075 343/747 |
| 2015/0188236 | A1 * | 7/2015 | Oppenlaender | H01Q 15/24 343/893 |
| 2015/0222022 | A1 * | 8/2015 | Kundtz | H01Q 13/22 343/771 |
| 2015/0349435 | A1 * | 12/2015 | Xue | H01Q 21/29 343/726 |
| 2016/0372839 | A1 * | 12/2016 | Watson | H01Q 9/42 |
| 2017/0062908 | A1 * | 3/2017 | Sanderovich | H01Q 1/246 |
| 2018/0151947 | A1 * | 5/2018 | Apostolos | H01Q 1/2291 |
| 2018/0175515 | A1 * | 6/2018 | Boutayeb | H01Q 21/30 |
| 2019/0006751 | A1 * | 1/2019 | Chen | H04B 7/10 |
| 2019/0140364 | A1 * | 5/2019 | Mirmozafari | H01Q 1/246 |
| 2019/0165478 | A1 | 5/2019 | Jo et al. | |
| 2019/0196107 | A1 * | 6/2019 | Sakr | H01Q 19/136 |
| 2019/0267710 | A1 * | 8/2019 | Jenwatanavet | H01Q 21/065 |
| 2019/0386400 | A1 * | 12/2019 | Wu | H01Q 5/371 |
| 2020/0044365 | A1 * | 2/2020 | Song | H01Q 5/392 |
| 2020/0067183 | A1 * | 2/2020 | Chang | H01Q 21/24 |
| 2020/0083948 | A1 * | 3/2020 | Lim | H01Q 1/243 |
| 2020/0106187 | A1 | 4/2020 | Ou et al. | |
| 2020/0119453 | A1 * | 4/2020 | Takayama | H01Q 1/243 |
| 2020/0161749 | A1 * | 5/2020 | Onaka | H01Q 21/24 |
| 2020/0194897 | A1 * | 6/2020 | Ananth | H04B 10/501 |
| 2020/0212539 | A1 | 7/2020 | Yun et al. | |
| 2020/0280133 | A1 * | 9/2020 | Avser | H01Q 5/42 |
| 2020/0287297 | A1 * | 9/2020 | Boutayeb | H01Q 1/50 |
| 2020/0382162 | A1 * | 12/2020 | Park | H04B 3/54 |
| 2021/0098894 | A1 * | 4/2021 | Haviv | H01Q 1/38 |
| 2021/0328364 | A1 * | 10/2021 | Jia | H01Q 9/0435 |
| 2022/0123470 | A1 * | 4/2022 | Kim | H01Q 15/006 |
| 2022/0131279 | A1 * | 4/2022 | Kim | H01Q 1/364 |
| 2022/0224021 | A1 * | 7/2022 | Song | H01Q 21/08 |

FOREIGN PATENT DOCUMENTS

| | | | | |
|---|---|---|---|---|
| CN | 106099323 | A * | 11/2016 | H01Q 1/241 |
| CN | 206673070 | U * | 11/2017 | |
| CN | 110911805 | B * | 7/2021 | H01Q 1/246 |
| CN | 113659312 | A * | 11/2021 | H01Q 1/246 |
| CN | 114243267 | A * | 3/2022 | H01Q 1/521 |
| CN | 114725698 | A * | 7/2022 | H01Q 21/062 |
| EP | 2787576 | A1 * | 10/2014 | H01Q 1/32 |
| EP | 3748774 | A1 | 12/2020 | |
| FR | 2943466 | A1 * | 9/2010 | H01Q 13/06 |
| JP | 2001111331 | A * | 4/2001 | |
| JP | 2001111332 | A * | 4/2001 | |
| JP | 2001111336 | A * | 4/2001 | |
| JP | 2002043838 | A * | 2/2002 | H01Q 21/062 |
| WO | WO-0154229 | A1 * | 7/2001 | H01Q 21/062 |
| WO | WO-2004075344 | A1 * | 9/2004 | H01Q 21/293 |
| WO | WO-2004100315 | A1 * | 11/2004 | H01Q 21/26 |
| WO | WO-2007132094 | A1 * | 11/2007 | G06K 19/0724 |
| WO | WO-2008033068 | A1 * | 3/2008 | H01P 1/205 |
| WO | WO-2011154954 | A2 * | 12/2011 | H01Q 1/243 |
| WO | WO-2013041560 | A1 * | 3/2013 | H01Q 19/10 |
| WO | WO-2014173451 | A1 * | 10/2014 | H01Q 1/241 |
| WO | WO-2016093728 | A1 * | 6/2016 | H01Q 21/24 |
| WO | WO-2017086377 | A1 * | 5/2017 | H01P 1/30 |
| WO | WO-2017177091 | A1 * | 10/2017 | H01Q 1/242 |
| WO | WO-2018230475 | A1 * | 12/2018 | H01Q 1/243 |
| WO | WO-2020133508 | A1 * | 7/2020 | H01Q 1/243 |
| WO | WO-2021128514 | A1 * | 7/2021 | H01Q 1/36 |
| WO | WO-2021206366 | A1 * | 10/2021 | G06K 19/0724 |
| WO | WO-2022019680 | A1 * | 1/2022 | H01Q 15/24 |
| WO | WO-2022224650 | A1 * | 10/2022 | H01Q 21/062 |

* cited by examiner

MULTI-DIRECTIONAL DUAL-POLARIZED ANTENNA SYSTEM

BACKGROUND

Wireless communication devices are increasingly popular and increasingly complex. For example, mobile telecommunication devices have progressed from simple phones, to smart phones with multiple communication capabilities (e.g., multiple cellular communication protocols, Wi-Fi, BLUETOOTH® and other short-range communication protocols), supercomputing processors, cameras, etc. Wireless communication devices have antennas to support communication over a range of frequencies.

Because a mobile device can be moved, the orientation of the mobile device to a communication base station can change. To help ensure quality communication between a mobile device and a base station, antenna systems of mobile devices are designed to send and receive wireless signals in numerous directions relative to the mobile device, thus providing broad antenna coverage to help the mobile device exchange signals with the base station regardless of a direction of the base station relative to the mobile device. Providing broad antenna coverage, however, may be difficult, especially using mobile wireless communication devices with small form factors.

SUMMARY

An example antenna system includes: an energy distribution network; a first antenna element configured and coupled to the energy distribution network to transduce between first wireless energy and first transmission-line-conducted energy and to transduce between second wireless energy and second transmission-line-conducted energy, wherein the first wireless energy is of a first polarization of the first antenna element and in a first direction and the second wireless energy is of a second polarization of the first antenna element and in a second direction, the first direction and the second direction being different and defining a first plane; and a second antenna element configured and coupled to the energy distribution network to transduce between third wireless energy and third transmission-line-conducted energy and to transduce between fourth wireless energy and fourth transmission-line-conducted energy, wherein the third wireless energy is of a first polarization of the second antenna element and in a third direction and the fourth wireless energy is of a second polarization of the second antenna element and in a fourth direction, the third direction and the fourth direction being different and defining a second plane that is substantially orthogonal to the first plane.

An example method of using an antenna system includes transducing wireless energy in two polarizations with a first antenna element having a first antenna boresight in a first direction, and transducing wireless energy in two polarizations with a second antenna element having a second antenna boresight in a second direction. The first direction may be angled with respect to the second direction, and/or the first and second antenna elements may be stacked.

Another example antenna system includes first means for transducing wireless energy in two polarizations and second means for transducing wireless energy in two polarizations. The first means have a first antenna boresight in a first direction, and the second means have a second antenna boresight in a second direction. The first direction may be angled with respect to the second direction, and/or the first means and the second means may be stacked.

DETAILED DESCRIPTION

Techniques are discussed herein for antenna systems that include multi-directional, dual-polarized antenna systems. For example, multiple arrays of dual-polarized antenna elements may be provided that have antenna boresights in different directions, e.g., orthogonal to each other. For example, an antenna module may comprise a substrate in which multiple antenna arrays are disposed, with one antenna array having an antenna boresight directed out of one surface of the substrate and another antenna array having an antenna boresight directed out of another surface of the substrate. One array may comprise multiple antenna elements (e.g., patch antenna elements) configured to radiate and receive dual-polarized signals, e.g., orthogonally polarized signals. Another array may comprise an array of antenna elements configured to radiate and receive signals of multiple polarizations in different (e.g., orthogonal) directions. For example, the antenna elements may each comprise a combination of a dipole and an open-ended waveguide. Each of the dipole and waveguide may radiate and receive signals of a respective polarization, with the polarizations being in different (e.g., orthogonal) directions. Still other examples of antenna elements and/or combinations of antenna elements may be used. Other configurations, however, may be used.

Figure 6:
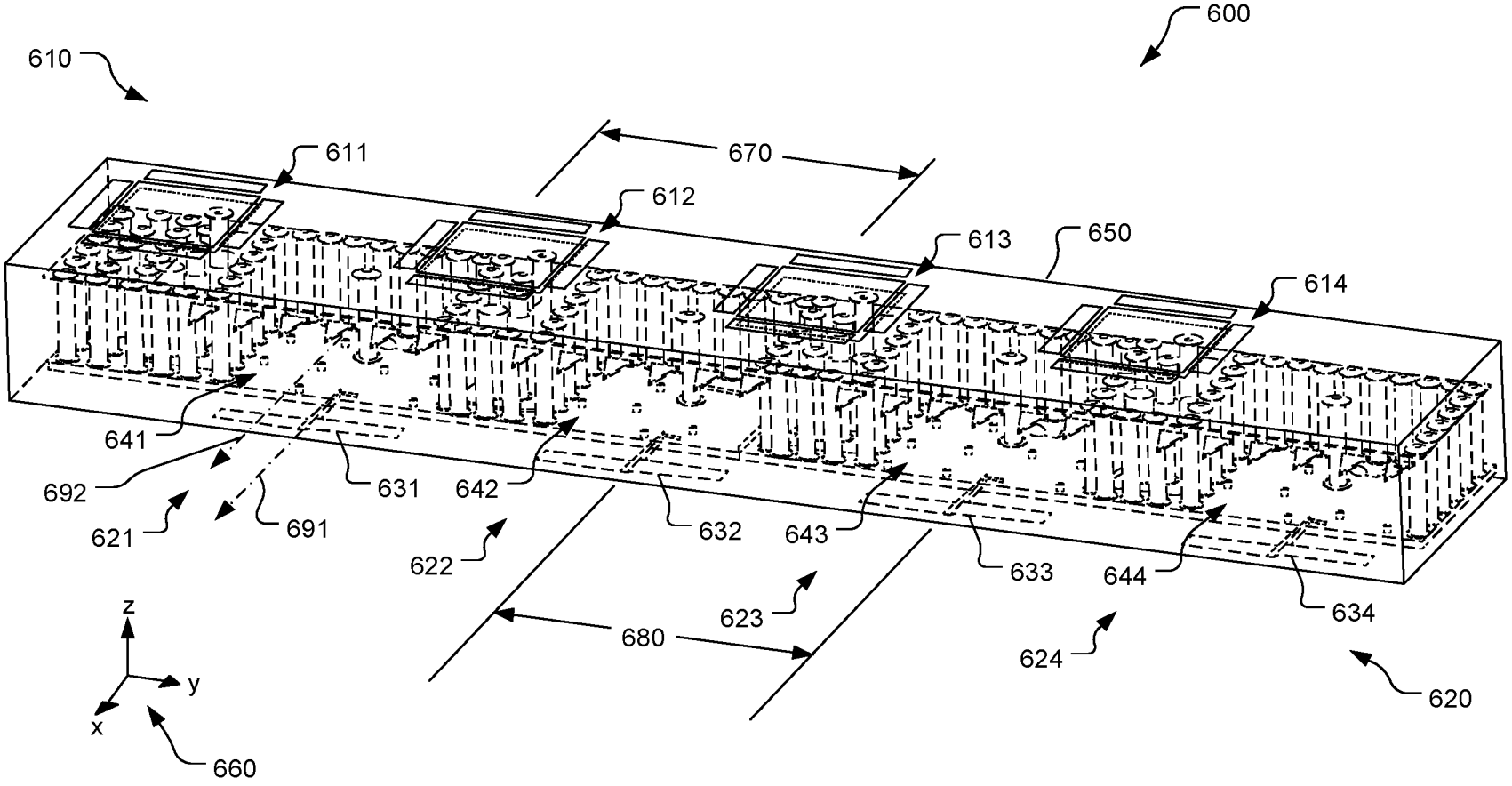
FIG. 6 is a perspective view of an example of the antenna system shown in FIG. 5.
Figure 14:
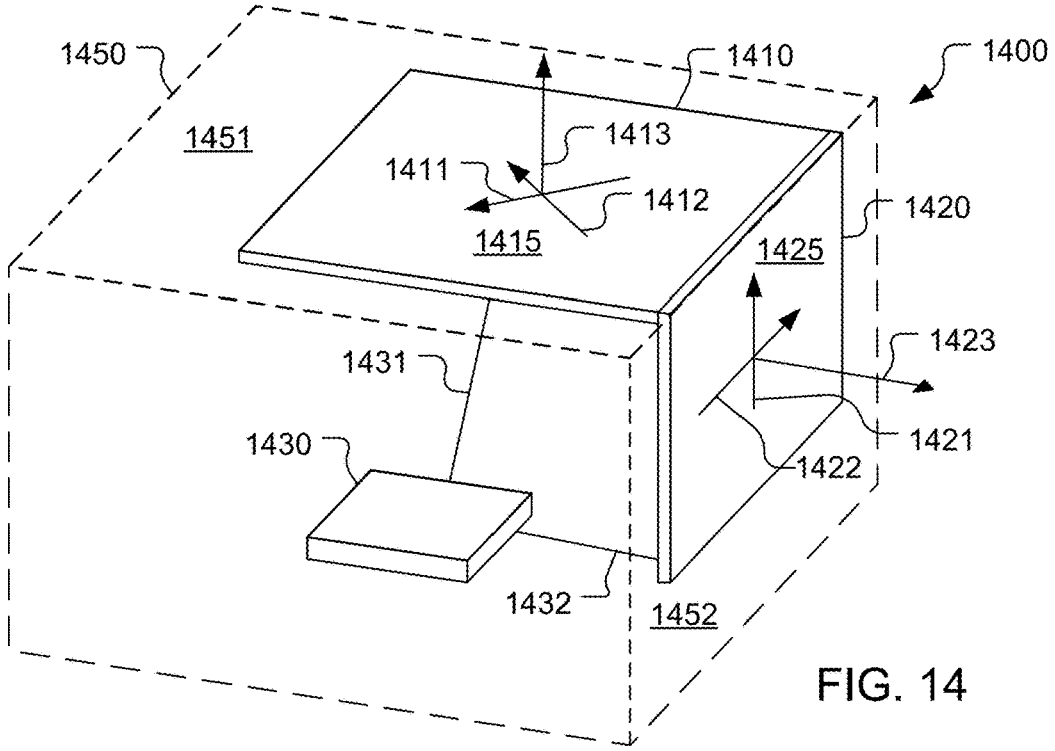
FIG. 14 is a perspective view of an example antenna system.

Antenna systems in accordance with the disclosure may have a variety of configurations, e.g., without including arrays of antenna elements. For example, referring to FIG. 14, an antenna system 1400 may include a first antenna element 1410, a second antenna element 1420, and an energy distribution network 1430. The first antenna element 1410 and the second antenna element 1420 are coupled to the energy distribution network 1430 to provide energy to the energy distribution network 1430 and/or to receive energy from the energy distribution network 1430. The energy distribution network 1430 is coupled to the first antenna element 1410 by an energy coupler 1431 and is coupled to the second antenna element 1420 by an energy coupler 1432. The energy distribution network 1430 and the energy couplers 1431, 1432 may be portions of energy couplers 324 shown in FIG. 3, and may include multiple elements each (e.g., energy couplers 714, 715 shown in FIG. 7). The first antenna element 1410 is configured to transduce between transmission line energy in the energy coupler 1431 and wireless energy with dual polarization in directions 1411, 1412. The directions 1411, 1412 define a plane 1415 (by the intersection of the directions 1411, 1412), that is substantially orthogonal (e.g., 90°+/−10°) of an antenna boresight 1413 of the first antenna element 1410 (i.e., a direction normal to a radiation aperture of the first antenna element 1410). The second antenna element 1420 is configured to transduce between transmission line energy in the energy coupler 1432 and wireless energy with dual polarization in directions 1421, 1422. The directions 1421, 1422 define a plane 1425 (by the intersection of the directions 1421, 1422), that is substantially orthogonal (e.g., 90°+/−10°) of an antenna boresight 1423 of the second antenna element 1420 (i.e., a direction normal to a radiation aperture of the second antenna element 1420). The planes 1415, 1425 may be substantially orthogonal (e.g., 90°+/−10°) to each other, with the antenna boresights 1413, 1423 being substantially orthogonal (e.g., 90°+/−10°) to each other. A patch antenna element 611 shown in FIG. 6 is an example of the first antenna element 1410 and an antenna element 621 shown in FIG. 6 is an example of the second antenna element 1420. Thus, for example, the patch antenna element 611 is configured to transduce between transmission-line energy and wireless energy with dual polarization (first and second polarizations), and a dipole 631 and a waveguide 641 are configured to transduce between transmission-line energy and wireless energy with two polarizations in two directions (e.g., a third direction and a fourth direction), with first and second directions of the first and second polarizations defining a plane that is substantially orthogonal to a plane defined by the polarizations and directions (e.g., the third and fourth directions) of the dipole 631 and the waveguide 641 (e.g., the antenna element 621). A single radiator in the patch antenna element 611 may transduce between transmission-line energy and wireless energy with dual polarization, or two radiators in the patch antenna element 611 may each transduce between transmission-line energy and wireless energy with a respective polarization. Numerous other types of antenna elements may be used for the first antenna element 1410 and/or the second antenna element 1420, such as monopoles, dipoles, loop antenna elements, helical antenna elements, radiating apertures (e.g., open-ended waveguides, slotted waveguides), lenses, microstrips with resonant stubs, slotlines with resonant stubs, patch radiators, etc. The antenna system 1400 may include a substrate 1450 that includes a surface 1451 and a surface 1452, with the surfaces 1451, 1452 being substantially orthogonal (e.g., 90°+/−10°). The first antenna element 1410 may be disposed to radiate energy away from the first surface 1451 and the second antenna element 1420 may be disposed to radiate energy away from the second surface 1452.

Antenna systems in accordance with the disclosure may be compact, occupying small volumes relative to wavelengths of signals that the antenna systems are configured to radiate/receive. For example, a combination of the first antenna element 1410 and the second antenna element 1420 may fit within a volume of a cube of a free-space wavelength on each side at a signal frequency that the antenna elements 1410, 1420 are configured to radiate/receive. For example, the combination of the first antenna element 1410 and the second antenna element 1420 may fit within a volume of 0.6λ by 0.4λ by 0.3λ (e.g., of a length 791, a width 792, and a height 793, shown in FIG. 7, with the height 793 also shown in FIG. 8), or even a volume of 0.6λ by 0.4λ by 0.2λ at a frequency of a signal that the antenna elements 1410, 1420 are configured to radiate/receive.

Figure 15:
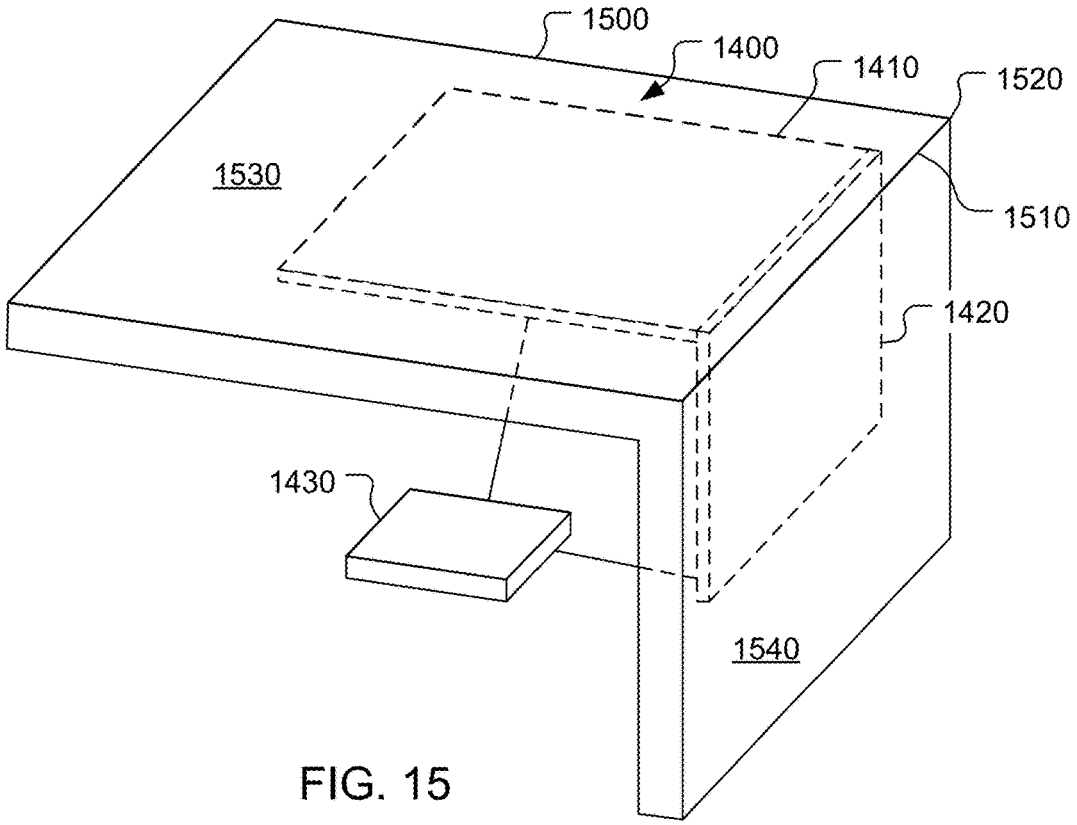
FIG. 15 is a perspective view of the antenna system shown in FIG. 14 disposed in a housing.

At least some antenna systems in accordance with the disclosure may be used in a variety of applications and devices. For example, antenna systems discussed may be used in wireless communication devices such as mobile phones, tablet computers, etc. For example, referring also to FIG. 15, the antenna system 1400 may be disposed within a housing 1500 of a wireless communication device, with a portion of the housing 1500 being shown in FIG. 15. In the example shown, the antenna system 1400 is disposed within the housing 1500 adjacent to a two-surface corner 1510 that is a junction of a surface 1540 (e.g., a front surface (e.g., a front of a phone or tablet) or a rear surface (e.g., a back of the phone or tablet)) and a surface 1530 (e.g., a side or edge surface). The antenna system 1400 may be disposed within the housing 1500 adjacent to a three-surface corner 1520 that is a junction of the surface 1530, the surface 1540, and another surface (not shown). The antenna system 1400 may be disposed (as shown) to facilitate transmission and reception of wireless signals by the first antenna element 1410 and the second antenna element 1420.

Items and/or techniques described herein may provide one or more of the following capabilities, as well as other capabilities not mentioned. Multi-directional, multi-polarized signals may be transmitted from and received at an antenna system. Communication between a mobile device and another entity (e.g., a base station, another mobile device, etc.) may be improved by transmitting and receiving multi-directional, multi-polarized signals. A single antenna system may be used to transmit and receive multi-directional, multi-polarized signals. Using a single antenna system for transmitting and receiving communication signals (e.g., multi-directional, multi-polarized signals) may save volume (e.g., of a mobile device), reduce cost, and/or reduce power consumption compared to using multiple antenna modules. The system may be integrated into a compact form factor, e.g., a thin module (e.g., a daughterboard) that may be connected to other components of a larger device, e.g., a mobile phone, a tablet computer, etc. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

Figure 1:
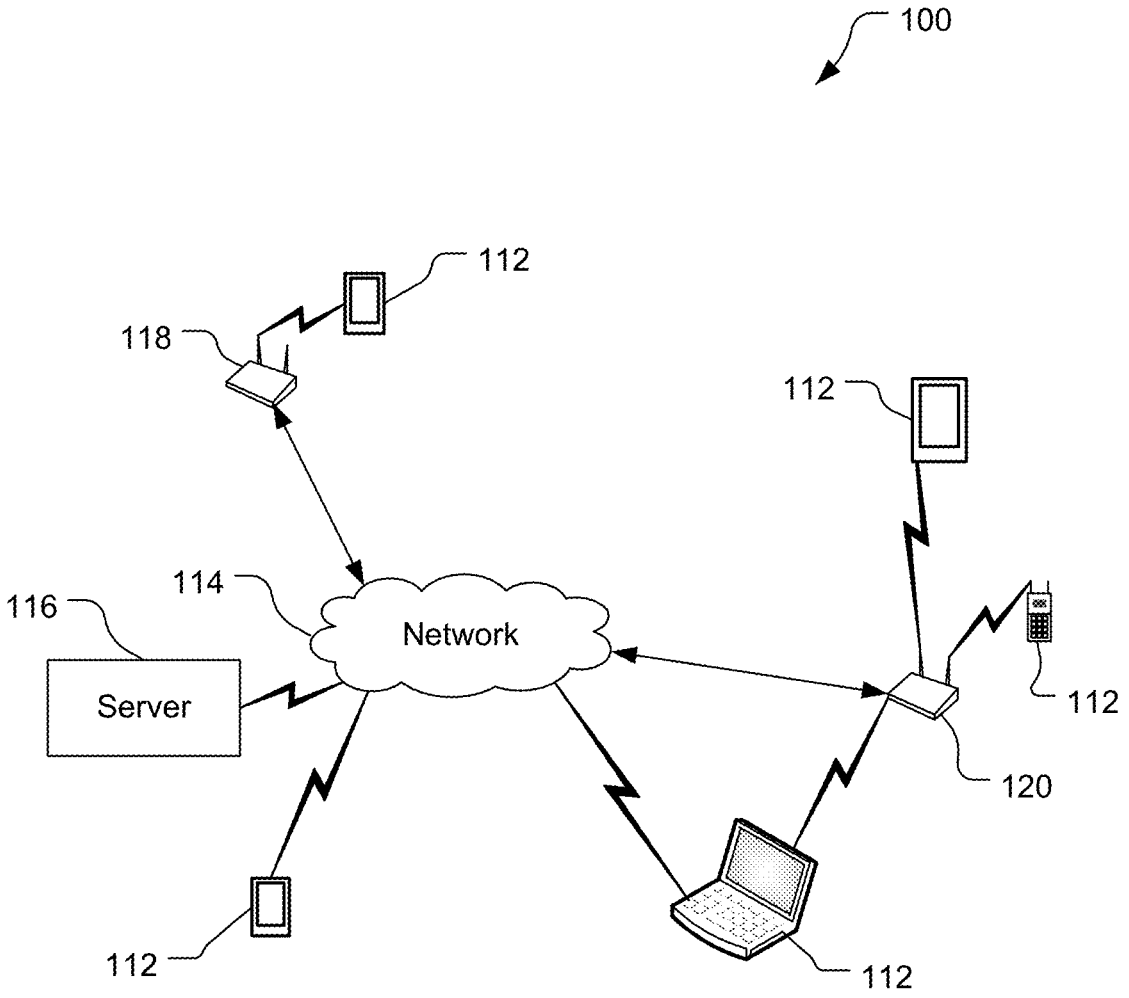
FIG. 1 is a schematic diagram of a communication system.

Referring to FIG. 1, a communication system 100 includes mobile devices 112, a network 114, a server 116, and access points (APs) 118, 120. The communication system 100 is a wireless communication system in that components of the communication system 100 can communicate with one another (at least some times) using wireless connections directly or indirectly, e.g., via the network 114 and/or one or more of the access points 118, 120 (and/or one or more other devices not shown, such as one or more base transceiver stations). For indirect communications, the communications may be altered during transmission from one entity to another, e.g., to alter header information of data packets, to change format, etc. The mobile devices 112 shown are mobile wireless communication devices (although they may communicate wirelessly and via wired connections) including mobile phones (including smartphones), a laptop computer, and a tablet computer. Still other mobile devices may be used, whether currently existing or developed in the future. Further, other wireless devices (whether mobile or not) may be implemented within the communication system 100 and may communicate with each other and/or with the mobile devices 112, network 114, server 116, and/or APs 118, 120. For example, such other devices may include internet of thing (IoT) devices, medical devices, home entertainment and/or automation devices, automotive devices, etc. The mobile devices 112 or other devices may be configured to communicate in different networks and/or for different purposes (e.g., 5G, Wi-Fi communication, multiple frequencies of Wi-Fi communication, satellite positioning, one or more types of cellular communications (e.g., GSM (Global System for Mobiles), CDMA (Code Division Multiple Access), LTE (Long-Term Evolution), etc.), Bluetooth® communication, etc.).

Figure 2:
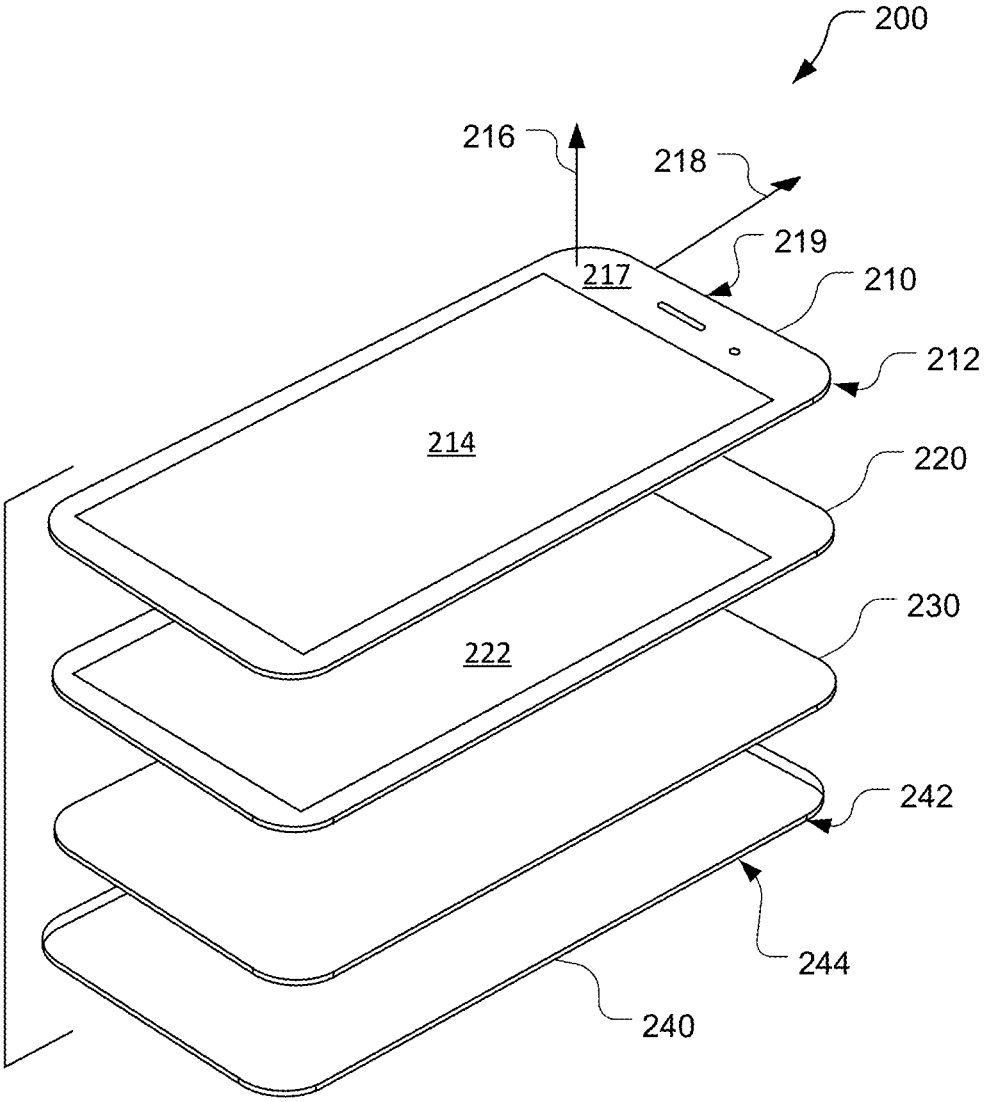
FIG. 2 is an exploded perspective view of simplified components of a mobile device shown in FIG. 1.

Referring to FIG. 2, a mobile device 200, which is an example of one of the mobile devices 112 shown in FIG. 1, includes a top cover 210, a display layer 220, a printed circuit board (PCB) layer 230, and a bottom cover 240. The mobile device 200 as shown may be a smartphone or a tablet computer but embodiments described herein are not limited to such devices. The top cover 210 includes a screen 214. The bottom cover 240 has a bottom surface 244. Sides 212, 242 of the top cover 210 and the bottom cover 240 provide an edge surface. The top cover 210 and the bottom cover 240 comprise a housing that retains the display layer 220, the PCB layer 230, and other components of the mobile device 200 that may or may not be on the PCB layer 230. For example, the housing may retain (e.g., hold, contain) or be integrated with antenna systems, front-end circuits, an intermediate-frequency circuit, and a processor discussed below. The housing may be substantially rectangular, having two sets of parallel edges in the illustrated embodiment, and may be configured to bend or fold. In this example, the housing has rounded corners, although the housing may be substantially rectangular with other shapes of corners, e.g., straight-angled (e.g., 45°) corners, 90°, other non-straight corners, etc. Further, the size and/or shape of the PCB layer 230 may not be commensurate with the size and/or shape of either of the top or bottom covers or otherwise with a perimeter of the device. For example, the PCB layer 230 may have a cutout to accept a battery. Further, the PCB layer 230 may include a PCB daughter board. Daughter boards may be chosen to facilitate a design and/or manufacturing process, e.g., to reinforce a functional separation or to better utilize a space in the housing. Embodiments of the PCB layer 230 other than those illustrated may be implemented.

Figure 3:
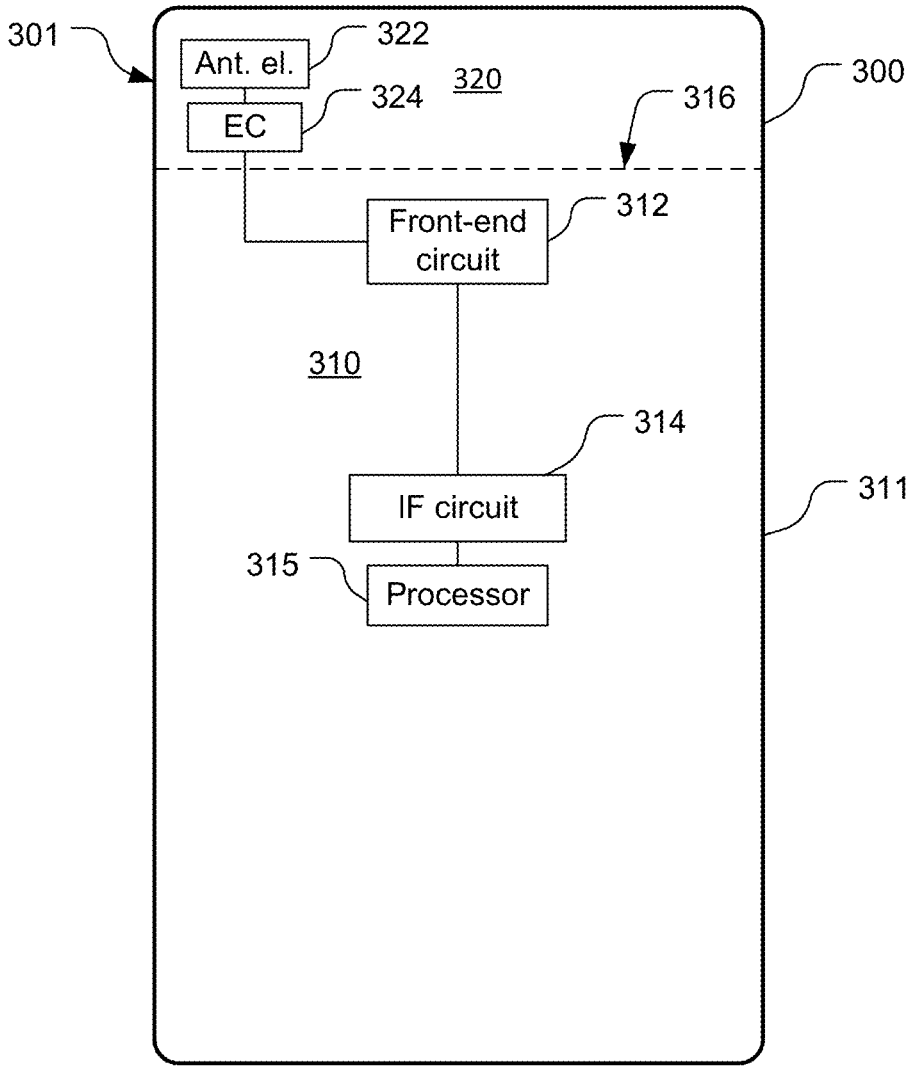
FIG. 3 is a top view of a printed circuit board, shown in FIG. 2, and an antenna system.

Referring also to FIG. 3, a PCB layer 300, which is an example of the PCB layer 230, includes a main portion 310 and a portion comprising an antenna system 320. In the example shown, the antenna system 320 is disposed at an end 301 of the PCB layer 300, but the antenna system 320 may be disposed elsewhere, e.g., along a side edge of the PCB layer 300. The main portion 310 comprises a PCB 311 that includes a front-end circuit 312 (also called a radio frequency (RF) circuit), an intermediate-frequency (IF) circuit 314, and a processor 315. The front-end circuit 312 may be configured to provide signals to be radiated to the antenna system 320 and to receive and process signals that are received by, and provided to the front-end circuit 312 from, the antenna system 320. The front-end circuit 312 may be configured to convert received IF signals from the IF circuit 314 to RF signals (amplifying with a power amplifier as appropriate), and provide the RF signals to the antenna system 320 for radiation. The front-end circuit 312 is configured to convert RF signals received by the antenna system 320 to IF signals (e.g., using a low-noise amplifier and a mixer) and to send the IF signals to the IF circuit 314. The IF circuit 314 is configured to convert IF signals received from the front-end circuit 312 to baseband signals and to provide the baseband signals to the processor 315. The IF circuit 314 is also configured to convert baseband signals provided by the processor 315 to IF signals, and to provide the IF signals to the front-end circuit 312. The processor 315 is communicatively coupled to the IF circuit 314, which is communicatively coupled to the front-end circuit 312, which is communicatively coupled to the antenna system 320. In some examples, transmission signals may be provided from the IF circuit 314 to the antenna system 320 by bypassing the front-end circuit 312, for example when further upconversion is not required by the front-end circuit 312. Signals may be received from the antenna system 320 by bypassing the front-end circuit 312. In other examples, a transceiver separate from the IF circuit 314 is configured to provide transmission signals to and/or receive signals from the antenna system 320 without such signals passing through the front-end circuit 312. In some examples, the front-end circuit 312 is configured to amplify, filter, and/or route signals from the IF circuit 314 without upconversion to the antenna system 320. Similarly, the front-end circuit 312 may be configured to amplify, filter, and/or route signals from the antenna system 320 without downconversion to the IF circuit 314. A super-heterodyne architecture is illustrated in FIG. 3, but a direct conversion architecture may be implemented in some examples. In the example shown, the antenna system 320 is the sole antenna system of the PCB layer 300, but more than one antenna system may be included (e.g., multiple instances of the antenna system 320), and corresponding further components included (e.g., another front-end circuit and/or other antennas). Using a single antenna system instead of multiple antenna systems occupies less volume (possibly enabling the mobile device 200 to be smaller) and incurs less cost for making the mobile device 200.

In FIG. 3, the dashed line separating the antenna system 320 from the PCB 311 indicates functional separation of the antenna system 320 (and the components thereof) from other portions of the PCB layer 300. Portions of the antenna system 320 may be integral with the PCB 311, being formed as integral components of the PCB 311. One or more components of the antenna system 320 may be formed integrally with the PCB 311, and one or more other components may be formed separate from the PCB 311 and mounted to the PCB 311, or otherwise made part of the PCB layer 300 (e.g., on a PCB daughter board). Alternatively, the antenna system 320 may be formed separately from the PCB 311 and coupled to the front-end circuit 312. In some examples, one or more components of the antenna system 320 may be integrated with the front-end circuit 312, e.g., in a single module or on a single circuit board separate from the PCB 311. For example, the front-end circuit 312 may be physically attached to the antenna system 320, e.g., attached to a back side of a ground plane of the antenna system 320. An antenna of the antenna system 320 may have front-end circuitry electrically (conductively) coupled and physically attached to the antenna while another antenna may have the front-end circuitry physically separate, but electrically coupled to the other antenna.

FIG. 3 shows the antenna system 320 as the sole antenna system, disposed at one end of the PCB 311, but other configurations may be used. For example, the antenna system 320 may be disposed at a different location than shown. As another example, more than one antenna system may be included, e.g., with one or more other antenna systems disposed at an opposite end of the PCB 311 from the antenna system 320, and/or along one or more sides of the PCB 311, etc. For further antenna system(s), further energy coupler(s) and front-end circuit(s) may be provided.

A display 222 (see FIG. 2) of the display layer 220 may roughly cover the same area as the PCB 311, or may extend over a significantly larger area (or at least over different regions) than the PCB 311, and may serve as a system ground plane for portions, e.g., feed lines or other components, of the antenna system 320 and/or other components of the device 112, e.g., feed line(s) connected to the antenna system 320. The PCB 311 may also provide a ground plane for components of the system. The display 222 may be coupled to the PCB 311 to help the PCB 311 serve as a ground plane. The display 222 may be disposed below the antenna system 320 (with "above" and "below" being relative to the mobile device 200 as illustrated in FIG. 3, i.e., with a top of the mobile device 200 being above other components regardless of an orientation of the device 112 relative to the Earth). In some embodiments, the antenna system 320 may have a width approximately equal to a width of the display 222. The antenna system 320 may extend less than about 10 mm (e.g., 8 mm) from an edge, here an end 316, of the display 222 (shown in FIG. 3 as coinciding with ends of the PCB 311 for convenience, although ends of the PCB 311 and the display 222 may not coincide). This may provide sufficient electrical characteristics for communication using the antenna system 320 without occupying a large area within the device 112. In some embodiments, the antenna system 320 partially or wholly overlaps with the PCB 311 and/or the display 222. In some embodiments, one or more antenna systems are disposed to the side (relative to the mobile device 200 as illustrated in FIG. 3) of the PCB 311 and/or the display 222. In some embodiments, the antenna elements 322 of the antenna system 320 include antenna elements configured and disposed to have multiple boresights (directions of maximum gain assuming the antenna elements are disposed in free space and absent beam steering) in different directions, e.g., with one boresight directed through one surface of the mobile device 200 (e.g., a direction 216 through a front surface 217) and another boresight directed through an adjoining surface (e.g., a direction 218 through a side surface 219). The antenna elements 322 may be configured to communicate signals in different or additional directions with respect to the mobile device 200, for example out of another side surface or out of the bottom surface 244 of the bottom cover 240.

The antenna system 320 includes antenna elements 322 and corresponding energy couplers 324. In examples discussed herein, the antenna elements 322 are configured and disposed to provide multiple, dual-polarized arrays. The antenna elements 322 may be referred to as "radiators" although the antenna elements 322 may radiate energy and/or receive energy. The energy couplers 324 may be referred to as "feeds," but an energy coupler may convey energy to a radiator from a front-end circuit, or may convey energy from a radiator to the front-end circuit. An energy coupler may be conductively connected to a radiator or may be physically separate from the radiator and configured to reactively (capacitively and/or inductively) couple energy to or from the radiator.

Figure 4:
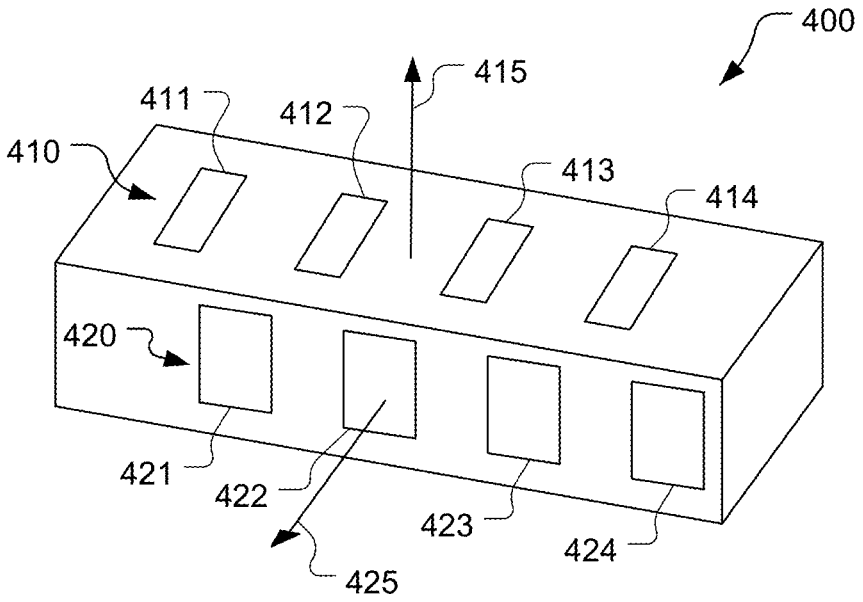
FIG. 4 is a perspective view of an example of an antenna system shown in FIG. 3.

Referring to FIG. 4, with further reference to FIG. 3, an antenna system 400 is an example of the antenna system 320. The antenna system 400 includes an array 410 of antenna elements 411, 412, 413, 414 and an array 420 of antenna elements 421, 422, 423, 424. The arrays 410, 420 each include four antenna elements in this example, but other quantities of antenna elements may be used, including different quantities of antenna elements in different arrays. The antenna system 400 is configured as a multi-directional (here bi-directional), dual-polarized antenna system. Each of the antenna elements 411-414, 421-424 is a dual-polarized antenna element (configured to transmit or receive energy in two different polarizations). The antenna elements 411-414, 421-424 may be configured to be cross-polarized, radiating and receiving signals with orthogonal polarizations. An antenna element may comprise multiple antenna elements to provide a dual-polarization capability, e.g., with different antenna elements configured to provide a single polarization and different antenna elements arranged with different orientations to provide the dual polarization. A single antenna element may be configured to provide dual polarization, e.g., due to different energy couplings (e.g., a patch with multiple energy couplings for transmitting and/or receiving energy with dual polarization). The antenna system 400 is bi-directional in that the array 410 is configured and disposed such that an antenna boresight 415 of the array 410 is in a different direction than an antenna boresight 425 of the array 420. In some examples, the boresight 415 is substantially orthogonal to the boresight 425. For example, the antenna type of the antenna elements 411-414 of the array 410 may be different from the antenna type of the antenna elements 421-424 of the array 420, with the different antenna types facilitating a configuration and arrangement such that the boresight 415 is in a different direction than boresight 425. The antenna system 400 may be configured as a stacked antenna system with the antenna elements 411-414 sharing a layer with the antenna elements 421-424 or abutting the antenna elements 421-424. For example, the antenna system 400 may be configured as a stacked antenna system with the antenna elements 411-415 corresponding to a first antenna type and being stacked on the antenna elements 421-425 corresponding to a second antenna type. Various antenna element types may be used for the antenna elements 411-416 and/or the antenna elements 421-425, including wire antennas (including monopoles and dipoles), loop antennas, helical antennas, aperture antennas (including waveguide antennas, e.g., slotted waveguides), lens antennas, planar microstrip antennas (including microstrips with resonant stubs), patch antennas, etc. The antenna elements 411-414 and the antenna elements 421-424 may be configured to transduce signals between wireless signals and wired signals over a similar frequency range, e.g., 24 GHz-29.5 GHz. The array 410 may be a phased array and/or the array 420 may be a phased array configured with independent energy couplers coupled to the antenna elements 411-414 and/or the antenna elements 421-424 such that different phase shifts may be applied to the energy couplers to steer a beam (transmit and/or receive) of the array 410 and/or the array 420. For example, the processor 315 may control phases applied to outbound signals to the antenna system 320 (e.g., the antenna system 400) and/or inbound signals from the antenna system 320 to steer beams provided by the arrays 410, 420. The arrays 410 and 420 may be coupled to separate processing elements in the front-end circuit 312, IF circuit 314, and processor 315, or may be coupled to common processing elements in any of these circuits/processor. For example, the array 410 may be configured to send different data from the array 420, or the same data may be selectively routed to either the array 410 or 420 (or may be routed to both arrays in some examples), such that the data may be transmitted in one (or more) of multiple directions.

Figure 5:
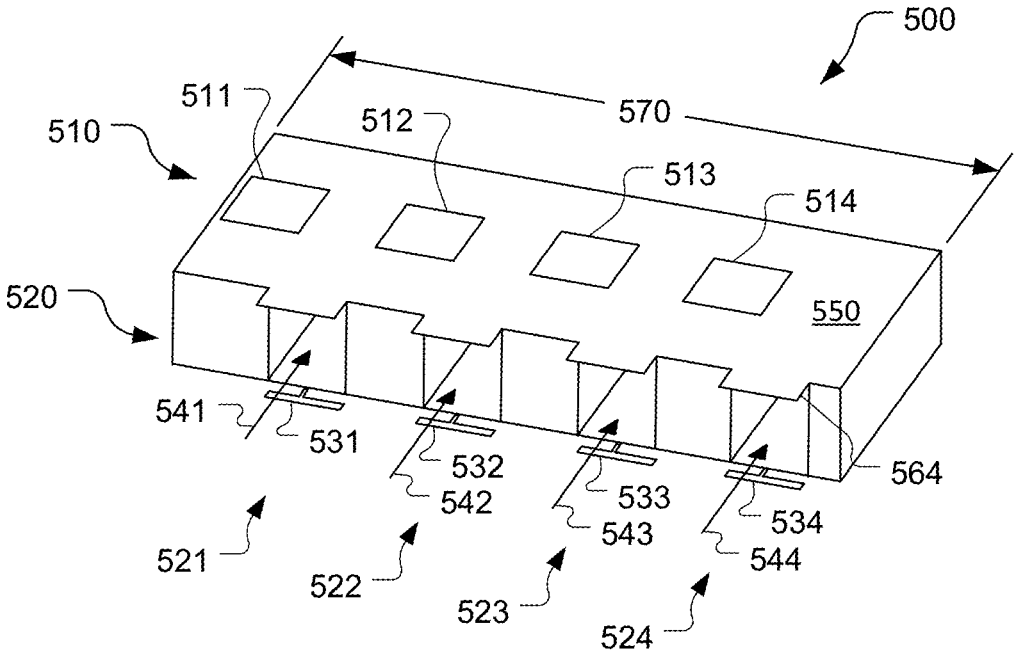
FIG. 5 is a perspective view of an example of the antenna system shown in FIG. 4.

Referring also to FIG. 5, an antenna system 500 is an example of the antenna system 400 and includes an array 510 of patch antenna elements 511, 512, 513, 514 and an array 520 of antenna elements 521, 522, 523, 524. The patch antenna elements 511-514 may be coupled to (e.g., directly, conductively coupled or reactively coupled (e.g., capacitively coupled)) to energy couplers to have the patch antenna elements 511-514 radiate and/or receive dual polarized signals, e.g., at substantially cross diagonals of the patch antenna elements 511-514 (which may be referred to as +/−45° slant polarization). The patch antenna elements 511-514 could be excited for vertical and horizontal polarization along edges of the patch antenna elements 511-514 instead of along cross diagonals. The antenna elements 521-524 comprise dipoles 531, 532, 533, 534 (dipole antenna elements), respectively, and waveguides 541, 542, 543, 544 (waveguide antenna elements), respectively, with each of the antenna elements 521-524 comprising a dipole/waveguide pair. The dipoles 531-534 and the waveguides 541-544 are configured and oriented to provide different polarizations (e.g., substantially orthogonal polarizations (e.g., between 80° and 100° of each other). The antenna system 500 is bi-directional for reasons similar to why the antenna system 400 is bi-directional. The antenna system 500 may be configured as a stacked antenna system with the patch antenna elements 511-514 sharing a layer with the antenna elements 521-524 or abutting the antenna elements 521-524. For example, a conductive layer 550 may serve as a conductive wall for the waveguides 541-544 and as a ground plane for the patch antenna elements 511-514. The conductive layer 550 includes, in this example, matching tabs 564 corresponding to the waveguides 541-544 (e.g., a matching tab 564 corresponding to the waveguide 544) to serve as impedance matching mechanisms to compensate for differences between impedances of the waveguides and an impedance of free space to facilitate signal transition between free space and the waveguides 541-544. The matching tabs 564 are shown for simplicity as solid rectangles, but this is illustrative and indicative of matching tabs generally, and not of a specific configuration. Other configurations of matching tabs may be used, e.g., multiple pieces that are separate from each other and possibly separate from the conductive layer 550, or the matching tabs may be omitted. In the example shown, the patch antenna elements 511-514 alternate with the antenna elements 521-524 along a length 570 of the antenna system 500. In other examples, the antenna elements 521-524 may be aligned with respective antenna elements 511-514, or a portion (e.g., the dipoles 531-534) of the antenna elements 521-524 may be aligned with respective antenna elements 511-514.

Referring also to FIG. 6, an antenna system 600 is an example of the antenna system 500 and includes an array 610 of patch antenna elements 611, 612, 613, 614, and an array 620 of antenna elements 621, 622, 623, 624 that comprise dipoles 631, 632, 633, 634 and waveguides 641, 642, 643, 644. Here, each of the patch antenna elements 611-614 comprises stacked patches and the waveguides 641-644 are open-ended substrate-integrated waveguides (SIWs). The antenna system 600 is bi-directional and each of the arrays 610, 620 is dual polarized as discussed further herein. The antenna system 600 is an example, and other configurations may be used, e.g., with more or fewer patch antenna elements, more or fewer dipoles, and/or more or fewer waveguides. The antenna system 600 includes a substrate 650 in which the arrays 610, 620 are disposed (e.g., built by depositing conductive material to form pads and planar conductors in an x-y plane, based on coordinate axes 660, filling or lining holes with conductive material to form vias in the z-direction, etc.). The antenna system 600 is bi-directional, with the array 610 configured and disposed to have a (mechanical) boresight approximately in the z-direction and the array 620 to have a (mechanical) boresight approximately in the x-direction such that the (mechanical) boresights of the arrays 610, 620 are approximately orthogonal, although the antenna system 600 may be configured to have other angle relationships of the boresights. A center-to-center spacing 670 of the patch antenna elements 611-614 may be chosen to provide a desired or acceptable combination of gain and antenna pattern (e.g., to avoid grating lobes of a threshold gain level), e.g., to be about half of a wavelength in free space at a lowest frequency of a desired frequency range for the antenna system 600. A center-to-center spacing 680 of the antenna elements 621-624 may be similarly chosen. The dipoles 631-634 are substantially aligned with the waveguides 641-644, with respective centerlines 691, 692 being substantially coplanar (e.g., with a plane containing the centerlines 691, 692 being coplanar with the x-z plane)+/−10°. The substrate 650 may be a monolithic substrate, with components of the antenna system 600 disposed in and/or retained by the substrate 650. The antenna system 600 may be built in layers, e.g., depositing layers of substrate and/or metal in desired pattern to build up the components of the antenna system 600.

In some examples, one or more of the antenna elements 621-624 are completely enclosed by a volume defined by projecting outermost edges of the antenna elements 611-614 down to a bottom of the substrate 650 (or down to a bottom of another substrate which includes the antenna elements 621-624, as described below). In other examples, a portion of the one or more antenna elements 621-624 are enclosed by such volume and another portion (e.g., a dipole portion) extends outside of the volume by a small amount, for example by less than 1 mm (e.g., less than about 0.5 mm).

Figure 7:
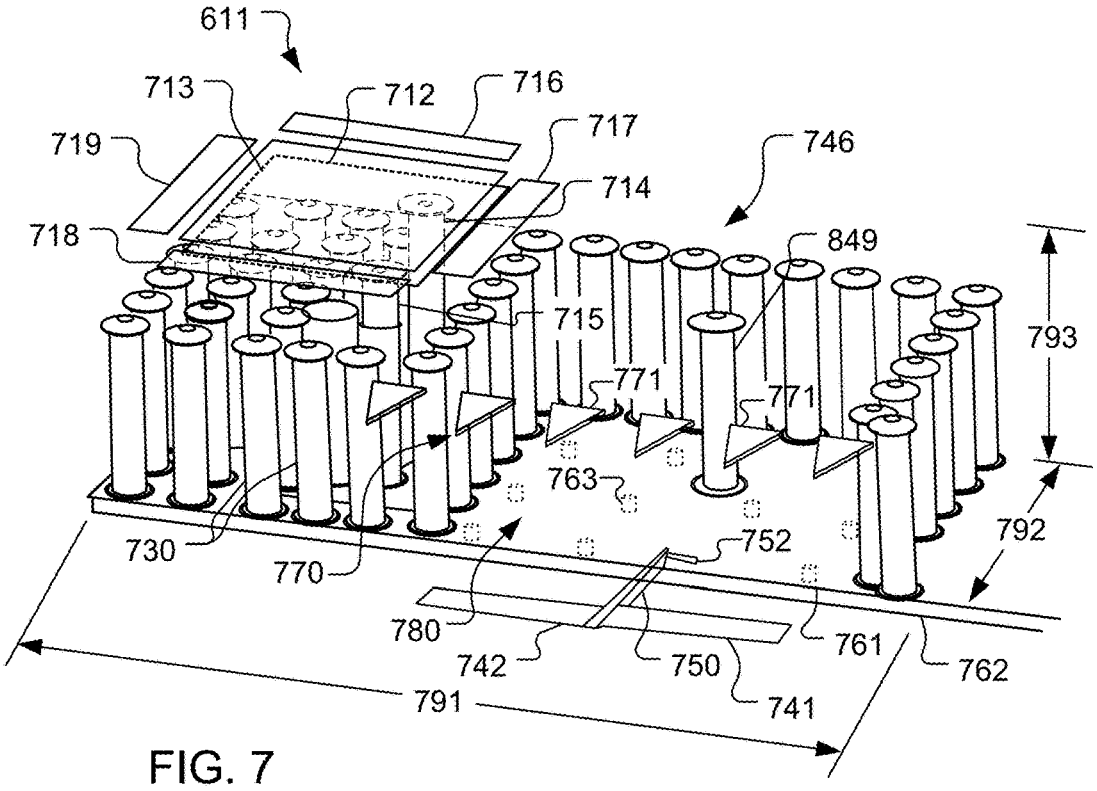
FIG. 7 is a perspective view of a portion of the antenna system shown in FIG. 6 with a substrate removed.
Figure 8:
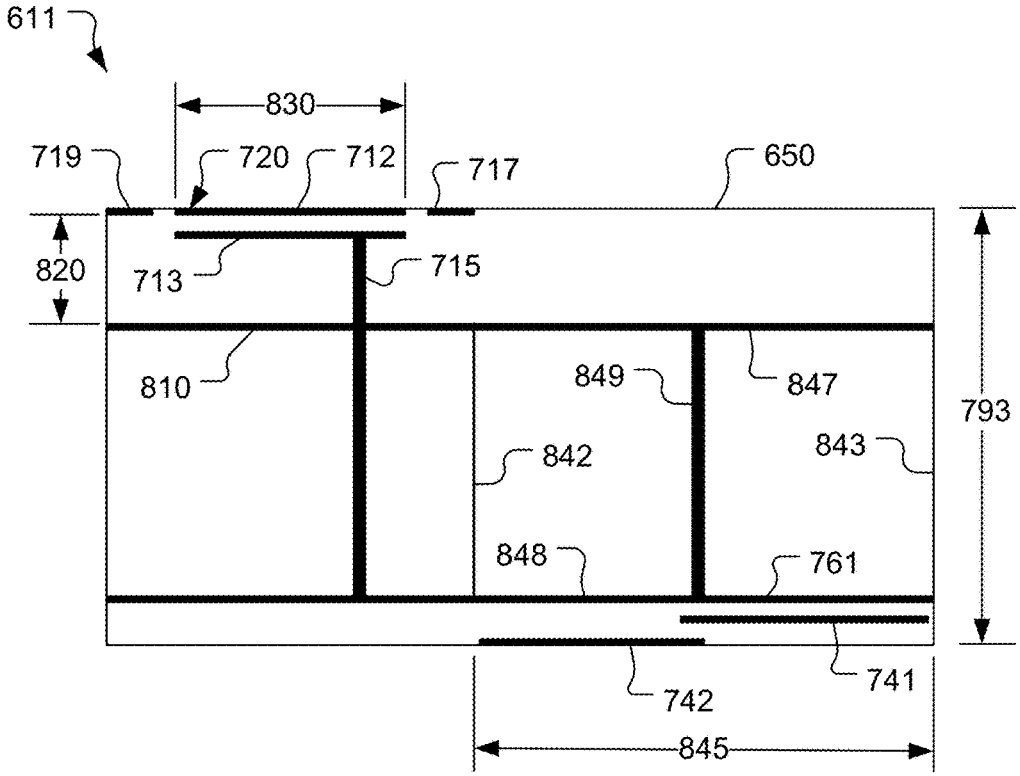
FIG. 8 is a side elevation view of antenna elements shown in FIG. 7.

Referring also to FIGS. 7 and 8, which show a perspective view and a side view, respectively, of the patch antenna element 611, and the dipole 631 and the waveguide 641 of the antenna element 621, the patch antenna element 611 comprises stacked patches 712, 713, and isolated conductors 716, 717, 718, 719. The patch antenna element 611 is coupled to energy couplers 714, 715. The isolated conductor 718 is omitted from FIG. 8 such that FIG. 8 shows the stacked patch 712. Conductive poles 730 and other features are omitted from FIG. 8 to simplify the figure and facilitate understanding. A conductive layer 810 provides a ground plane for the patch antenna element 611 and in one example is displaced from the stacked patch 713 by a distance 820 of about $1/10^{th}$ of a wavelength in the substrate 650 (e.g., about 0.5 mm for a dielectric constant of the substrate 650 of about 3.5 and a frequency of about 29.5 GHz). The stacked patches 712, 713 are separated from each other, aligned with each other, and of approximately the same size (e.g., the stacked patch 713 may be slightly larger than the stacked patch 712), although other configurations may be used. The arrangement of the stacked patches 712, 713 may help the antenna system 600 provide broadband performance. In the example shown, the patch 712 and the isolated conductors 717, 719 are at least partially disposed within the substrate 650, e.g., completely within the substrate 650, although configurations may be used where the patch 712 and the isolated conductors 717, 719 are not completely within the substrate 650. Alternatively, the patch 712 and the isolated conductors 716-719 may be disposed on the substrate 650. With at least a surface 720 of the patch 712 outside of the substrate 650, the patch may effectively be exposed to free space. The dipole 631 is at least partially disposed within the substrate 650. In this example, the dipole 631 is fully disposed within the substrate, but configurations with the dipole 631 extending to or even beyond an outer surface of the substrate 650 may be used. While an example stacked patch configuration is described and illustrated herein, a single patch may be used. Further, one or more of the isolated conductors 716, 717, 718, 719 may be omitted.

The patch antenna element 611 is electrically conductive and sized and shaped for operation over a desired frequency band. For example, the patch antenna element 611 may radiate more than half of the energy provided to the patch antenna element 611 in the desired frequency band, or may have a resonance in the desired frequency band, etc. In the example shown, the stacked patches 712, 713 have rectangular shapes, in this case being substantially square (with side lengths of the stacked patch 712 being within 5% of each other and side lengths of the stacked patch 713 being within 5% of each other). Side lengths 830 of the stacked patch 712 may be about half of a wavelength (e.g., 40%-60% of the wavelength) of a signal having a frequency in the desired frequency band (e.g., the lower frequency band) and travelling in the substrate 650 of the antenna system 600, e.g., a dielectric in which the patch antenna element 611 is disposed. The side lengths 830 in this example are edge lengths of edges configured to radiate or receive electromagnetic signals.

Figure 9:
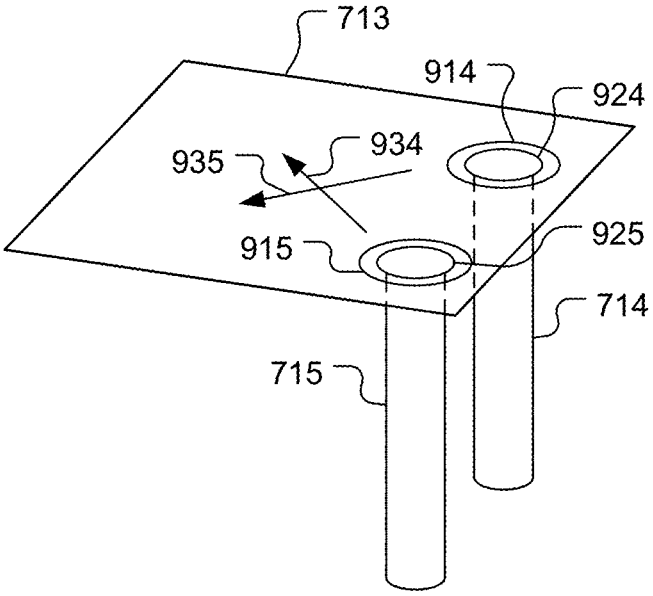
FIG. 9 is a perspective view of energy couplers capacitively coupled to a patch of the antenna system shown in FIG. 6.

The energy couplers 714, 715 are configured and disposed to provide energy to and/or receive energy from the stacked patches 712, 713. The energy couplers 714, 715 may directly or indirectly provide energy to and/or receive energy from the stacked patch 713. For example, the energy couplers 714, 715 may comprise electrically-conductive components of transmission lines, e.g., microstrip lines, coaxial transmission lines, etc., physically connected to the stacked patch 713. Alternatively, the energy couplers 714, 715 may comprise devices that are physically separate from the stacked patch 713 and that are configured and disposed to reactively couple energy to and/or from the stacked patch 713. For example, referring also to FIG. 9, the energy couplers 714, 715 are reactively (e.g., capacitively) coupled to the stacked patch 713. Openings are defined in the conductive layer 810 and the energy couplers 714, 715 extend through the openings in the conductive layer 810 to the stacked patch 713. The stacked patch 713 defines openings 914, 915 and the energy couplers 714, 715 are connected to conductive pads 924, 925 disposed in the openings 914, 915, respectively. The energy couplers 714, 715 capacitively couple to the stacked patch 713, and the stacked patch 713 capacitively couples to the stacked patch 712. The energy couplers 714, 715 are capacitively coupled to the stacked patch 713 at respective locations to induce and/or receive energy at respective polarizations 935, 934. The polarizations 934, 935 define a plane that is substantially parallel to the stacked patch 713 (e.g., within 10° of a plane of the stacked patch 713 (e.g., a top surface of the stacked patch 713)). As the stacked patch 713 is a square, and the polarizations 934, 935 are directed across diagonals of the square, the polarization of the patch antenna element 611 may be referred to as a +/−45° slant polarization. Other configurations, however, may be used. For example, the energy couplers 714, 715 may be coupled to the stacked patch 713 at locations other than those shown, e.g., rotated 45° relative to the configuration shown in FIG. 9 such that the stacked patch 713 would radiate in directions rotated 45° relative to the polarizations 934, 935 (which may be referred to as horizontal polarization and vertical polarization). As another example, one or more of the energy couplers may be directly connected to the stacked patch 713, or may terminate at a layer lower than the stacked patch 713 and reactively couple to the stacked patch 713. In other examples, openings in the stacked patch 713 allow the energy couplers 714, 715 to pass therethrough and the energy couplers 714, 715 are directly or reactively coupled to the stacked patch 712. In such examples, the isolated conductors 716, 717, 718, 719 may be in the same layer as the patch 712, in the same layer as the patch 713, or omitted. The energy couplers 714, 715 are illustrated as being coupled to a single radiator (e.g., the patch 713) such that the radiator is operative in two polarizations. In other examples, each of the energy couplers 714, 715 may be coupled to a respective radiator operative in a respective polarization. For example, multiple stacked patches which are operative in respective polarizations may be coupled to respective energy couplers.

Figure 10:
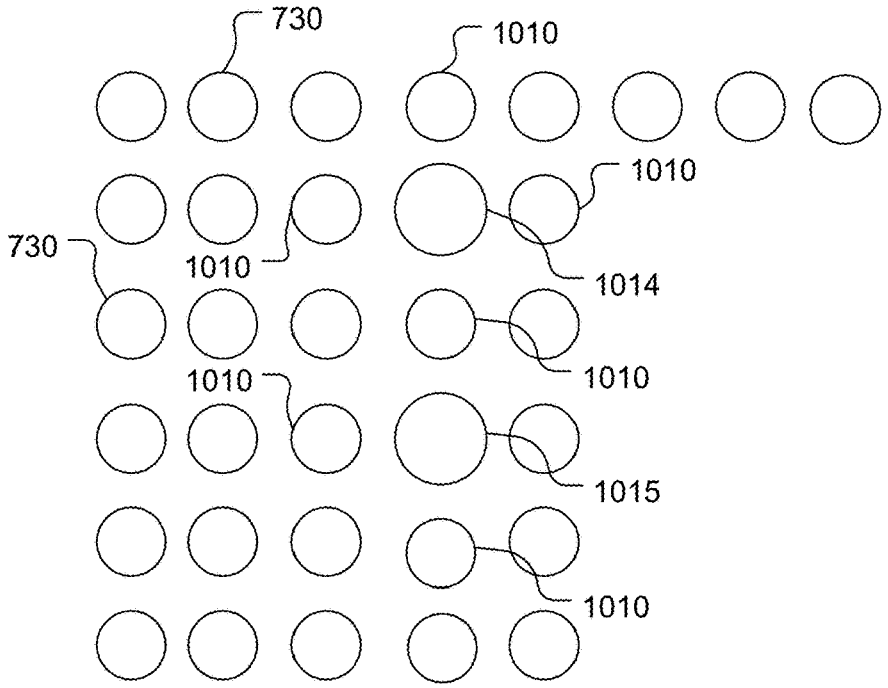
FIG. 10 is a simplified top view of conductive posts for waveguide walls and energy couplers.
Figure 11:
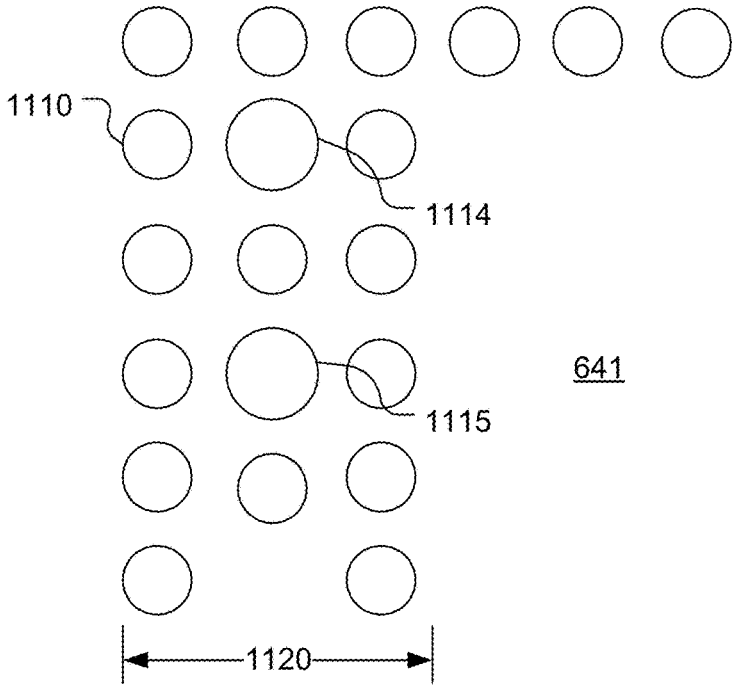
FIG. 11 is a simplified top view of an alternative arrangement of conductive posts for waveguide walls and energy couplers.

Referring also to FIG. 10, the energy couplers 714, 715 comprise respective coaxial transmission lines. Conductive poles 1010 (e.g., plated or filled vias through portions of the substrate 650), that are a subset of the conductive poles 730, are disposed around (though not fully surrounding) center conductors 1014, 1015 of the energy couplers 714, 715, respectively, with the conductive poles 1010 acting as outer conductors of coaxial transmission lines comprising the energy couplers 714, 715. The conductive poles 1010 may be disposed around (though not fully surrounding) the center conductors 1014, 1015 such that the coaxial transmission lines have impedances of about 50 ohms (50Ω). Other quantities of the conductive poles 730 may be used, e.g., using fewer of the conductive poles 730 to reduce a separation distance between waveguides and patch antenna elements. For example, referring also to FIG. 11, conductive poles 1110 are provided over a width 1120 in order to serve as outer conductors for center conductors 1114, 1115 for the energy couplers 714, 715 and to form a wall for the waveguide 641 and are absent beyond the width 1120. Each of the energy couplers 714, 715 is connected to another transmission line, e.g., a stripline transmission line using parallel conductive layers of the antenna system 600 (e.g., as discussed below with respect to the dipole 631), that connects directly or indirectly to a front-end circuit (e.g., the front-end circuit 312 shown in FIG. 3). The configuration of the conductive poles 730, among other factors, may affect dimensions of an antenna system. For example, using the configuration shown in FIG. 10, the antenna system 600 may be about 25.7 mm×about 4.4 mm×about 2.4 mm, while using the configuration shown in FIG. 11 may result in the antenna system 600 being about 24.5 mm by about 4.4 mm by about 2.4 mm.

Referring again in particular to FIGS. 7 and 8, the isolated conductors 716-719 may be configured (e.g., sized and shaped and material composition thereof) and disposed (e.g., located and oriented) to improve performance of the stacked patches 712, 713. Each of the isolated conductors 716-179 comprises electrically-conductive material (e.g., metal such as copper) and is isolated from (not electrically connected to, i.e., unconnected from, electrically separate from) the stacked patches 712, 713 and the energy couplers 714, 715 and any other conductive material of the antenna system 600. The isolated conductors 716-719 are not directly connected to a power source (e.g., by not being directly connected to the energy couplers 714, 715). Any of the isolated conductors 716-719 may be referred to as a parasitic element. Providing parasitic elements in conjunction with the stacked patches 712, 713 may improve bandwidth of the antenna system 600. For example, the isolated conductors 716-719 may help improve directionality (e.g., narrow a beamwidth) and/or improve gain of an antenna pattern of the antenna system 600. While one isolated conductor 716-719 is shown disposed near each of the sides of the stacked patch 712, other quantities of isolated conductors may be used. Isolated conductors of shapes other than rectangles may be used, e.g., circles, triangles, other regular shapes, irregular shapes, shapes that approximate a shape of a proximate edge of the stacked patch 713, etc. Isolated conductors may be disposed other than in a layer with the stacked patch 712 as shown (e.g., disposed in a different layer of the substrate 650 such as in a layer of the stacked patch 713 in addition to or instead of in the layer of the stacked patch 713). Isolated conductors may be oriented differently than as shown.

The isolated conductors 716-719 are laterally displaced from the stacked patch 712. The isolated conductors 716-719 may be disposed proximately to the stacked patch 712 and may be called isolated proximate conductors. For example, the isolated conductors 716-719 may have a minimum separation of about 0.1 mm although other separations are possible (e.g., down to a manufacturing limit, e.g., about 50 μm with present technology). In some examples, a portion of one or more of the isolated conductors 716-719 overlaps an edge of the stacked patch 713 (for example, when the stacked patch 712 is smaller than the stacked patch 713 or omitted).

The isolated conductors 716-719 are shown having the same shapes and lengths and terminating approximately even with ends of the stacked patch 712. This is an example and not limiting of the disclosure. The isolated conductors 716-719 may have different shapes and/or lengths. The isolated conductors 716-719 may terminate beyond an end of the stacked patch 712. The isolated conductors 716-719 may have any of various widths. For example, the isolated conductors 716-719 may have a width at least as large as a threshold width due to manufacturing constraints. For example, the isolated conductors 716-719 may be at least 50 microns in width (e.g., at their thinnest part if the width is not uniform). The lengths, widths, and/or shapes of the isolated conductors 716-719 may be limited, however, to avoid any of the isolated conductors 716-719 from connecting to each other. In other examples, one or more of the isolated conductors are connected together. For example, an isolated conductor may form a ring around the stacked patch 712.

Referring again in particular to FIGS. 6-8, the dipole 631 is illustrated as a split dipole with dipole arms 741, 742 that are separate from each other and are connected to respective portions of a stripline transmission line. A center conductor 750 is disposed between two conductive layers 761, 762 that together with the center conductor 750 form a stripline transmission line energy conductor. Conductive posts 763 electrically connect the conductive layers 761, 762. The conductive layer 762 is not shown in FIG. 8 in order to clearly show the dipole arm 742 because the dipole arm 742 is in the same layer as the conductive layer 762. For example, the dipole arm 742 may be integral with the conductive layer 762. The center conductor 750 extends from between the conductive layers 761, 762 and is connected to the dipole arm 741, e.g., being integral with the dipole arm 741. The dipole arms 741, 742 are disposed in different layers of the substrate 650 and overlap with each other to act as a balun. The dipole 631 is configured to radiate and receive energy with a polarization parallel to the x-y plane (FIG. 6). The center conductor 750 is connected to a matching stub 752 to help match an impedance of the stripline to an impedance of the dipole 631 to help improve efficiency of radiating and receiving energy via the dipole 631. The center conductor 750 is connected directly or indirectly (e.g., via another transmission line) to a front-end circuit (e.g., the front-end circuit 312 shown in FIG. 3). In other examples, the dipole 631 (and/or any of the other dipoles 632-634) is implemented in a single layer instead of as a split dipole (and may have ends separated from each other or may be connected in the middle).

The waveguide 641 is illustrated as an SIW, with walls of the waveguide 641 being provided by structures within the substrate 650. For example, width-bounding walls 842, 843 are provided by the conductive poles 730. The conductive poles 730 are spaced apart from each other, but close enough (e.g., less than a tenth of a wavelength apart) that electrically the conductive poles 730 act like a solid conductor. The width-bounding walls 842, 843 may be spaced apart by a waveguide width 845 such that a cutoff frequency of the waveguide 641 is below a lowest desired frequency of operation of the waveguide 641 (e.g., about ½ of a wavelength in the substrate 650 at the cutoff frequency, e.g., 24 GHz). In this configuration, the waveguide 641 is configured to propagate vertically polarized energy in a $TE_{10}$ mode (transverse electric, 1-0 mode), with a half-wave pattern across the width (between the width-bounding walls 842, 843) and no half-wave pattern across a height (between height-bounding walls 847, 848) of the waveguide 641. A rear wall 746 is provided by others of the conductive poles 730. The waveguide 641 is an open-ended waveguide because the waveguide 641 defines an aperture 780 instead of having a front (end) wall opposite the rear wall 746. The height-bounding walls 847, 848 are provided by the conductive layer 810 and the conductive layer 761, respectively. An energy coupler 849 is configured to couple energy to and from the waveguide 641, here extending from a transmission line (not shown) disposed between the conductive layers 761, 762 to the height-bounding wall 847. Other configurations, however, may be used, e.g., where the energy coupler is separated from, and reactively (e.g., capacitively) coupled to, the height-bounding wall 847. The waveguide 641 (e.g., the width-bounding walls 842, 843, the rear wall 746, the height-bounding walls 847, 848, and the energy coupler 849) is configured to have the waveguide 641 radiate and receive energy with a polarization substantially parallel to the x-z plane (FIG. 6) such that the antenna element 621 is dual polarized (in this case, with orthogonal or near-orthogonal polarizations due to the dipole 631 being polarized substantially parallel to the x-y plane).

The waveguide 641 is illustrated as including a matching mechanism 770 (which is an example of the matching tab 564) comprising conductive pieces 771. In this example, the matching mechanism 770 comprises six conductive pieces 771 each with a triangular shape, but other quantities and/or other shapes of conductive pieces 771 may be used. In this example, the matching mechanism 770 is disposed in the same layer as the conductive layer 810 and thus are not shown in FIG. 8. The matching mechanism 770 may be disposed in a different layer than the conductive layer 810, or partially in the same layer as, and partially in a different layer than, the conductive layer 810. The matching mechanism 770 is configured to improve efficiency of a transition of energy between inside and outside the waveguide 641, e.g., improving an impedance match between the waveguide 641 and free space. The matching mechanism 770 provides some symmetry about a port of the waveguide 641 with the dipole 631.

Figure 12:
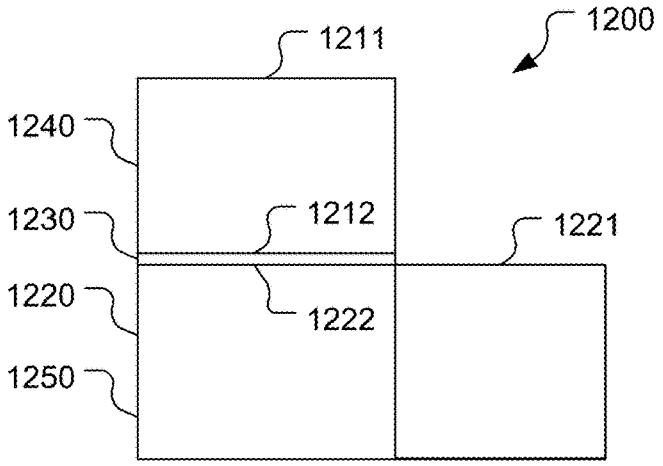
FIG. 12 is a simplified block diagram of a stacked antenna element antenna system.

The antenna system 600 is a stacked antenna system, with the array 610 being stacked on the array 620. For example, the patch antenna elements 611-614 are stacked on the array 620, with the patch antenna elements 611-614 sharing components with the array 620. In the example shown, the conductive layer 810 is disposed in the substrate 650 and shared by the patch antenna elements 611-614 and the waveguides 641-644, respective portions of the conductive layer 810 providing ground planes to the patch antenna elements 611-614 and height-bounding walls for the waveguides 641-644. Alternatively, arrays like the arrays 610, 620 may be stacked by being adjacent without sharing components. For example, referring to FIG. 12, an antenna system 1200 includes a patch antenna element 1211 disposed in a substrate 1240 and an array portion 1220 that includes a combined dipole and waveguide antenna element 1221 disposed in a substrate 1250 that is separate from the substrate 1240. The antenna system 1200 includes further patch antenna elements and further combined dipole and waveguide antenna elements, but solely the patch antenna element 1211 and the combined dipole and waveguide antenna element 1221 are conceptually shown for simplicity. The patch antenna element 1211 is stacked on the array portion 1220, e.g., being retained adjacent the array portion 1220 by a connection 1230 such as an adhesive or a conductive material connecting (mechanically and electrically) the patch antenna element 1211 and the array portion 1220. For example, a ground conductor 1212 of the patch antenna element 1211 may lie in a plane that is adjacent to a conductor 1222 (which may also be planar) of the array portion 1220 that provides a bounding wall for a waveguide of the combined dipole and waveguide antenna element 1221. The conductors 1212, 1222 may be adjacent, separated by the connection 1230 such as an adhesive. Alternatively, the connection 1230 may electrically connect the ground conductor 1212 to the conductor 1222. Thus, it can be seen that the connection 1230 maintains the conductors 1212, 1222—and the arrays 610, 620—in proximity to each other. Further, other antenna elements may be used, e.g., a monopole or a dipole instead of a patch antenna element, and/or other antenna elements discussed herein.

Figure 13:
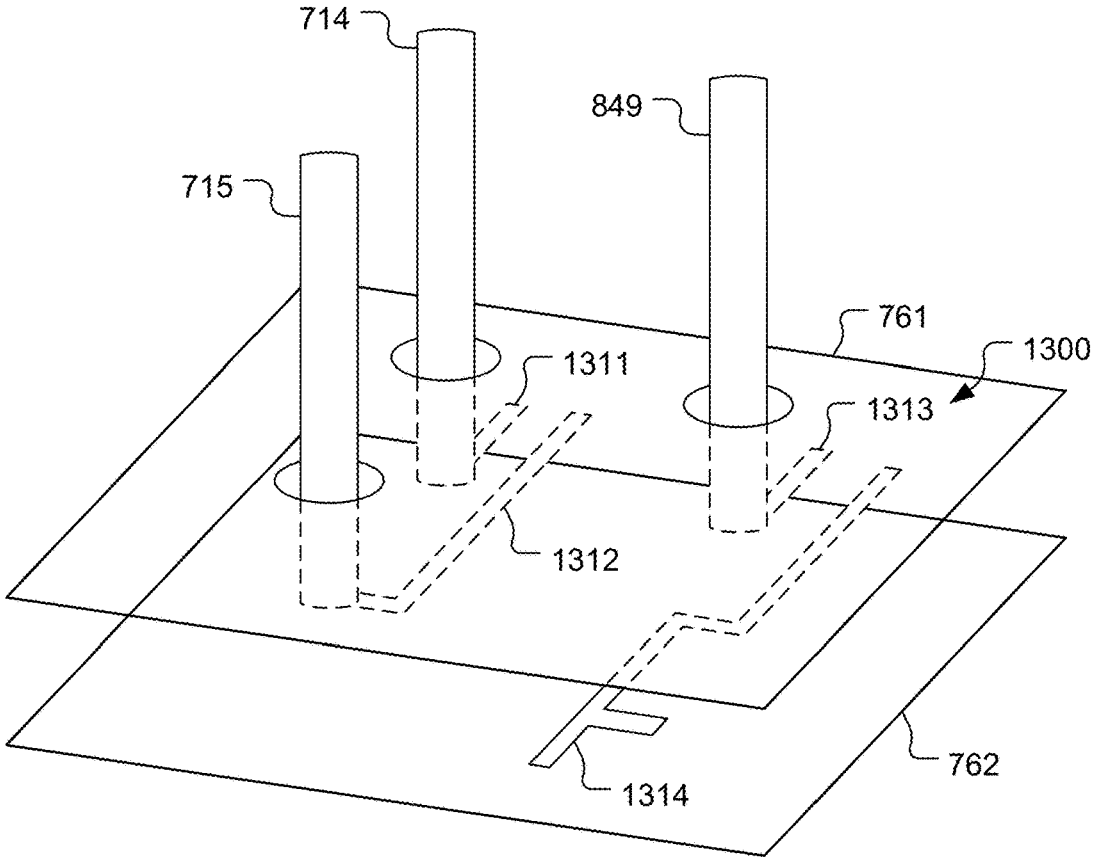
FIG. 13 is a perspective view of an energy distribution network and energy couplers of the antenna system shown in FIG. 6.

Referring also to FIG. 13, an energy distribution network 1300 for the patch antenna element 611 and the antenna element 621 includes four stripline transmission lines comprising respective portions of the conductive layers 761, 762 and four center conductors 1311, 1312, 1313, 1314, respectively. The center conductors 1311, 1312 are electrically connected to the energy couplers 714, 715 (for the patch antenna element 611), which extend through the conductive layer 761 without touching the conductive layer 761. The energy couplers 714, 715 for the patch antenna elements 612-614 will extend from the energy distribution network 1300 between respective pairs of the waveguides 641-644 (i.e., between the waveguides 641, 642, between the waveguides 642, 643, and between the waveguides 643, 644, respectively). For an antenna system, such as the antenna system 600, with N (or N−1) patch antenna elements and N waveguides, N−1 pairs of energy couplers extend from an energy distribution network between respective pairs of the waveguides to couple to respective patches. The center conductor 1313 is electrically connected to the energy coupler 849, which extends through the conductive layer 761 without touching the conductive layer 761. The center conductor 1314 (e.g., the center conductor 750) is electrically connected to the dipole arm 741. Referring also to FIG. 8, the patch antenna element 611 (e.g., the patches 712, 713) is disposed closer to the conductive layer 761 than to the conductive layer 762, and much of the antenna element 621 (e.g., the waveguide 641 and the dipole 631 except for the dipole arm 742) is disposed on the same side of the conductive layer 762 as the patch antenna element 611. A similar energy distribution network 1300 is provided for the other patch antenna elements 612-614 and the other antenna elements 622-624.

Figure 16:
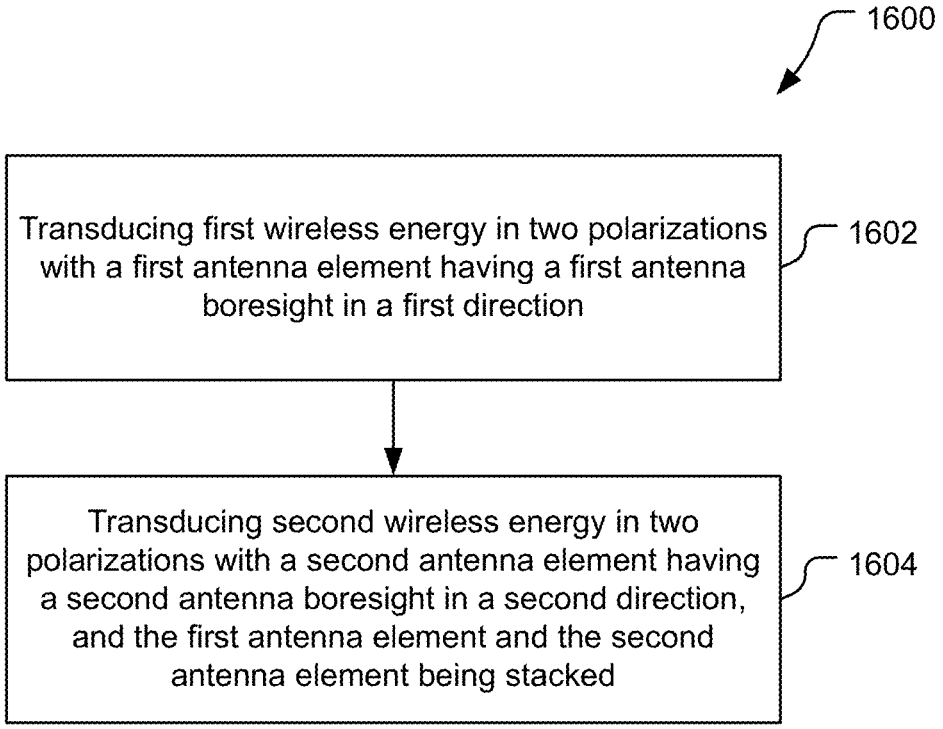
FIG. 16 is a block flow diagram of a method of using an antenna system.

Referring to FIG. 16, a block flow diagram of a method 1600 of using an antenna system is illustrated. The method 1600 is, however, an example only and not limiting. The method 1600 may be altered, e.g., by having stages added, removed, rearranged, combined, performed concurrently, and/or having single stages split into multiple stages.

At stage 1602, the method 1600 includes transducing first wireless energy in two polarizations with a first antenna element having a first antenna boresight in a first direction. For example, the first antenna element may comprise a patch antenna configured to transmit and/or receive (e.g., radiate) wireless signals having two polarizations in a first antenna boresight direction using transmission-line-conducted energy. The first antenna element 1410, possibly in combination with the energy distribution network 1430, may comprise means for transducing the first wireless energy. Energy transduced in the two polarizations by the first antenna element may relate to the same communication or different communications. For example, a single communication transmitted or received in two polarizations may provide diversity. As another example, each polarization may be used for a separate communication, for example in certain multiple-input and multiple-output (MIMO) systems.

At stage 1604, the method 1600 includes transducing second wireless energy in two polarizations by a second antenna element having a second antenna boresight in a second direction, and the first antenna element and the second antenna element being stacked. For example, the second antenna element may comprise a dipole and a waveguide configured to transmit and/or receive (e.g., radiate) wireless signals having two polarizations in a second antenna boresight direction using transmission-line conducted energy. The second antenna element 1420, possibly in combination with the energy distribution network 1430, may comprise means for transducing the second wireless energy. Energy transduced in the two polarizations by the second antenna element may relate to the same communication or different communications. For example, a single communication transmitted or received in two polarizations may provide diversity. As another example, each polarization may be used for a separate communication, for example in certain MIMO system. As another example, energy transduced by the first antenna element and energy transduced by the second antenna element may relate to the same communication, or may relate to different communications. Transducing energy related to the same communication may provide greater coverage for a device, for example, while transducing energy related to different communications may increase capacity, as another example.

The first direction and the second direction are angled with respect to each other (e.g., by more than approximately 45 degrees), and may be substantially orthogonal. The first antenna element and the second antenna element may be stacked. A plurality of such first antenna elements and a plurality of such second antenna elements may be included in the antenna system. In some examples, the plurality of first antenna elements alternate with at least one type (e.g., a waveguide) of antenna element of the plurality of second antenna elements. In some such examples, a second type (e.g., a dipole) of the plurality of second antenna elements is aligned with either the plurality of the first antenna elements or with the second type of the plurality of the second antenna elements. In some examples having a plurality of first antenna elements and a plurality of second antenna elements, the plurality of second antenna elements are enclosed within a volume defined by projecting outermost edges of the plurality of first antenna elements to a bottom of a substrate in which the first and second antenna elements are implemented, or to a bottom of a substrate in which the second antenna elements are implemented. In other embodiments, a portion of the second antenna elements extends outside of the volume by a small amount. A front-end circuit may be coupled to the first antenna element and the second antenna element. The front end-circuit may be located remote from the substrate and coupled thereto by an interconnect. In other examples, the front-end circuit is physically attached to the substrate, for example when the first antenna element, the second antenna element, and the substrate are packaged together in a module.

Other Configurations

The examples discussed above are non-exhaustive examples and numerous other configurations may be used. The discussion below is directed to some of such other configurations, but is not exhaustive (by itself or when combined with the discussion above).

Implementation Examples

Implementation examples are provided in the following numbered clauses.

Clause 1. An antenna system comprising:

an energy distribution network;

a first antenna element configured and coupled to the energy distribution network to transduce between first wireless energy and first transmission-line-conducted energy and to transduce between second wireless energy and second transmission-line-conducted energy, wherein the first wireless energy is of a first polarization of the first antenna element and in a first direction and the second wireless energy is of a second polarization of the first antenna element and in a second direction, the first direction and the second direction being different and defining a first plane; and a second antenna element configured and coupled to the energy distribution network to transduce between third wireless energy and third transmission-line-conducted energy and to transduce between fourth wireless energy and fourth transmission-line-conducted energy, wherein the third wireless energy is of a first polarization of the second antenna element and in a third direction and the fourth wireless energy is of a second polarization of the second antenna element and in a fourth direction, the third direction and the fourth direction being different and defining a second plane that is substantially orthogonal to the first plane.

Clause 2. The antenna system of clause 1, wherein the second antenna element comprises a dipole and a waveguide, the dipole being configured to transduce between the third wireless energy and the third transmission-line-conducted energy, and the waveguide configured to transduce between the fourth wireless energy and the fourth transmission-line-conducted energy.

Clause 3. The antenna system of clause 2, wherein the waveguide comprises an open-ended, substrate-integrated waveguide.

Clause 4. The antenna system of clause 3, further comprising a monolithic substrate, wherein the open-ended, substrate-integrated waveguide is disposed within the monolithic substrate, the dipole is at least partially disposed in the monolithic substrate, and the first antenna element is at least partially disposed within the monolithic substrate.

Clause 5. The antenna system of any of clauses 2 through 4, wherein a centerline of the waveguide and a centerline of the dipole are substantially coplanar.

Clause 6. The antenna system of any of clauses 2 through 5, wherein the first antenna element comprises a patch antenna element, the first antenna element is one of a plurality of first antenna elements of the antenna system, the second antenna element is one of a plurality of second antenna elements of the antenna system, and wherein the plurality of first antenna elements and the plurality of second antenna elements alternate along a length of the antenna system.

Clause 7. The antenna system of clause 6, wherein the plurality of first antenna elements comprises N patch antenna elements and the plurality of second antenna elements comprises N waveguides, where N is an integer greater than two, and wherein the antenna system further comprises N pairs of energy couplers, each of N−1 pairs of the N pairs of energy couplers being coupled to the energy distribution network, extending from the energy distribution network between a respective pair of the N waveguides, and coupling to a respective one of N−1 of the N patch antenna elements.

Clause 8. The antenna system of clause 6, further comprising a plurality of isolated conductors separated from, but disposed proximate to a plurality of sides of the patch antenna element.

Clause 9. The antenna system of any of clauses 2 through 8, further comprising an impedance matching mechanism configured to compensate for a difference between a first impedance of free space and a second impedance of the waveguide.

Clause 10. The antenna system of any of clauses 1 through 9, wherein the first antenna element shares a component with the second antenna element.

Clause 11. The antenna system of clause 10, further comprising:

a substrate;

a first ground conductor disposed in the substrate and comprising a portion of the first antenna element; and a second ground conductor of the second antenna element and disposed in the substrate;

wherein the first ground conductor and the second ground conductor comprise portions of a shared conductive layer of the antenna system.

Clause 12. The antenna system of clause 10, wherein the second antenna element comprises a dipole and an open-ended waveguide, the dipole being configured to transduce between the third wireless energy and the third transmission-line-conducted energy, and the open-ended waveguide configured to transduce between the fourth wireless energy and the fourth transmission-line-conducted energy.

Clause 13. The antenna system of any of clauses 1 through 12, wherein the first antenna element and the second antenna element are disposed within a volume of 0.6λ by 0.4λ by 0.3λ, with k being a free-space wavelength of a signal frequency that the first antenna element and the second antenna element are configured to radiate.

Clause 14. The antenna system of any of clauses 1 through 9 and 13, further comprising a first ground conductor comprising a portion of the first antenna element and a second ground conductor of the second antenna element, wherein the first ground conductor is disposed in a third plane and the second ground conductor is disposed in a fourth plane that is adjacent and parallel to the third plane.

Clause 15. The antenna system of clause 14, wherein the first ground conductor is connected to the second ground conductor.

Clause 16. The antenna system of clause 15, wherein the first ground conductor is electrically connected to the second ground conductor.

Clause 17. The antenna system of clause 15, further comprising:

a first substrate in which the first antenna element is at least partially disposed; and a second substrate in which the second antenna element is at least partially disposed, the second substrate being separate from the first substrate.

Clause 18. The antenna system of any of clauses 1 through 17, wherein the antenna system comprises a first conductive layer and a second conductive layer, the energy distribution network comprises portions of the first conductive layer and the second conductive layer, the first antenna element is disposed closer to the second conductive layer than to the first conductive layer, and at least a portion the second antenna element is disposed on a same side of a plane of the first conductive layer as the first antenna element.

Clause 19. The antenna system of any of clauses 1 through 18, wherein the second antenna element comprises a split dipole comprising a first arm and a second arm that is separate from the first arm, the energy distribution network comprises a first ground conductor, a second ground conductor, and a center conductor, and wherein the center conductor is electrically connected to the first arm of the split dipole and the second ground conductor is electrically connected to the second arm of the split dipole.

Clause 20. The antenna system of clause 19, wherein the first ground conductor, the second ground conductor, and the center conductor provide a stripline transmission line.

Clause 21. The antenna system of any of clauses 1 through 20, further comprising a substrate including a first surface and a second surface, the first surface being substantially orthogonal to the second surface, wherein the first antenna element is disposed to radiate the first wireless energy away from the first surface and the second antenna element is disposed to radiate the second wireless energy away from the second surface.

Clause 22. A method of using an antenna system, comprising:

transducing first wireless energy in two polarizations with a first antenna element having a first antenna boresight in a first direction; and transducing second wireless energy in two polarizations with a second antenna element having a second antenna boresight in a second direction, the first direction being angled with respect to the second direction, and the first antenna element and the second antenna element being stacked.

Clause 23. An antenna system, comprising:

first means for transducing first wireless energy in two polarizations, the first means having a first antenna boresight in a first direction; and second means for transducing second wireless energy in two polarizations, the second means having a second antenna boresight in a second direction, the first direction being angled with respect to the second direction, and the first means and the second means being stacked.

Clause 24. The antenna system of clause 23, wherein the first direction and the second direction are substantially orthogonal.

Clause 25. The antenna system of clause 23 or 24, wherein the first means comprises a plurality of antenna elements, wherein the second means comprises a plurality of antenna elements of a first type and a plurality of antenna elements of a second type, wherein the first means and the second means are arranged in an array, and wherein the plurality of antenna elements of the first means alternate with the plurality of antenna elements of the first type in the array.

Other Considerations

As used herein, "or" as used in a list of items prefaced by "at least one of" or prefaced by "one or more of" indicates a disjunctive list such that, for example, a list of "at least one of A, B, or C," or a list of "one or more of A, B, or C" means A or B or C or AB or AC or BC or ABC (i.e., A and B and C), or combinations with more than one feature (e.g., AA, AAB, ABBC, etc.).

The systems and devices discussed above are examples. Various configurations may omit, substitute, or add various procedures or components as appropriate. For instance, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the scope of the disclosure.

The invention claimed is:

1. An antenna system comprising:

a monolithic substrate;

an energy distribution network;

a first antenna element configured and coupled to the energy distribution network to transduce between first wireless energy and first transmission-line-conducted energy and to transduce between second wireless energy and second transmission-line-conducted energy, wherein the first wireless energy is of a first polarization of the first antenna element and in a first direction and the second wireless energy is of a second polarization of the first antenna element and in a second direction, the first direction and the second direction being different and defining a first plane; and a second antenna element configured and coupled to the energy distribution network to transduce between third wireless energy and third transmission-line-conducted energy and to transduce between fourth wireless energy and fourth transmission-line-conducted energy, wherein the third wireless energy is of a first polarization of the second antenna element and in a third direction and the fourth wireless energy is of a second polarization of the second antenna element and in a fourth direction, the third direction and the fourth direction being different and defining a second plane that is substantially orthogonal to the first plane, wherein the first antenna element is at least partially disposed within the monolithic substrate, wherein the second antenna element comprises a dipole and an open-ended, substrate-integrated waveguide, wherein the dipole is at least partially disposed in the monolithic substrate and is configured to transduce between the third wireless energy and the third transmission-line-conducted energy, and wherein the open-ended, substrate-integrated waveguide is disposed within the monolithic substrate and is configured to transduce between the fourth wireless energy and the fourth transmission-line-conducted energy.

2. The antenna system of claim 1, wherein a centerline of the open-ended, substrate-integrated waveguide and a centerline of the dipole are substantially coplanar.

3. The antenna system of claim 1, wherein the first antenna element comprises a patch antenna element, the first antenna element is one of a plurality of first antenna elements of the antenna system, the second antenna element is one of a plurality of second antenna elements of the antenna system, and wherein the plurality of first antenna elements and the plurality of second antenna elements alternate along a length of the antenna system.

4. The antenna system of claim 3, wherein the plurality of first antenna elements comprises N patch antenna elements and the plurality of second antenna elements comprises N of the open-ended, substrate-integrated waveguides, where N is an integer greater than two, and wherein the antenna system further comprises N pairs of energy couplers, each of N−1 pairs of the N pairs of energy couplers being coupled to the energy distribution network, extending from the energy distribution network between a respective pair of the N open-ended, substrate-integrated waveguides, and coupling to a respective one of N−1 of the N patch antenna elements.

5. The antenna system of claim 1, wherein the first antenna element shares a component with the second antenna element.

6. The antenna system of claim 5, further comprising:

a first ground conductor disposed in the monolithic substrate and comprising a portion of the first antenna element; and a second ground conductor of the second antenna element and disposed in the monolithic substrate;

wherein the first ground conductor and the second ground conductor comprise portions of a shared conductive layer of the antenna system.

7. The antenna system of claim 1, wherein the first antenna element and the second antenna element are disposed within a volume of 0.6λ by 0.4λ by 0.3λ, with λ being a free-space wavelength of a signal frequency that the first antenna element and the second antenna element are configured to radiate.

8. The antenna system of claim 1, further comprising a first ground conductor comprising a portion of the first antenna element and a second ground conductor of the second antenna element, wherein the first ground conductor is disposed in a third plane and the second ground conductor is disposed in a fourth plane that is adjacent and parallel to the third plane.

9. The antenna system of claim 8, wherein the first ground conductor is connected to the second ground conductor.

10. The antenna system of claim 9, wherein the first ground conductor is electrically connected to the second ground conductor.

11. The antenna system of claim 1, wherein the antenna system comprises a first conductive layer and a second conductive layer, the energy distribution network comprises portions of the first conductive layer and the second conductive layer, the first antenna element is disposed closer to the second conductive layer than to the first conductive layer, and at least a portion the second antenna element is disposed on a same side of a plane of the first conductive layer as the first antenna element.

12. The antenna system of claim 1, wherein the second antenna element comprises a split dipole comprising a first arm and a second arm that is separate from the first arm, the energy distribution network comprises a first ground conductor, a second ground conductor, and a center conductor, and wherein the center conductor is electrically connected to the first arm of the split dipole and the second ground conductor is electrically connected to the second arm of the split dipole.

13. The antenna system of claim 12, wherein the first ground conductor, the second ground conductor, and the center conductor provide a stripline transmission line.

14. The antenna system of claim 1, wherein the monolithic substrate includes a first surface and a second surface, the first surface being substantially orthogonal to the second surface, wherein the first antenna element is disposed to radiate the first wireless energy away from the first surface and the second antenna element is disposed to radiate the second wireless energy away from the second surface.

15. A method of using an antenna system, comprising:

transducing first wireless energy in two polarizations with a first antenna element having a first antenna boresight in a first direction; and transducing second wireless energy in two polarizations with a second antenna element having a second antenna boresight in a second direction, the first direction being angled with respect to the second direction, and the first antenna element and the second antenna element being stacked, wherein the first antenna element is at least partially disposed within a monolithic substrate, wherein the second antenna element comprises a dipole and an open-ended, substrate-integrated waveguide, wherein the dipole is at least partially disposed in the monolithic substrate and wherein the second wireless energy is transduced in a first polarization of the two polarizations with the dipole, and wherein the open-ended, substrate-integrated waveguide is disposed within the monolithic substrate and wherein the second wireless energy is transduced in a second polarization of the two polarizations with the open-ended, substrate-integrated waveguide.

16. An antenna system, comprising:

first means for transducing first wireless energy in two polarizations, the first means having a first antenna boresight in a first direction; and second means for transducing second wireless energy in two polarizations, the second means having a second antenna boresight in a second direction, the first direction being angled with respect to the second direction, and the first means and the second means being stacked, wherein the first means is at least partially disposed within a monolithic substrate, wherein the second means comprises a dipole and an open-ended, substrate-integrated waveguide, wherein the dipole is at least partially disposed in the monolithic substrate and is configured to transduce the second wireless energy in a first polarization of the two polarizations, and wherein the open-ended, substrate-integrated waveguide is disposed within the monolithic substrate and configured to transduce the second wireless energy in a second polarization of the two polarizations.

17. The antenna system of claim 16, wherein the first direction and the second direction are substantially orthogonal.

18. The antenna system of claim 17, wherein the first means comprises a plurality of antenna elements, wherein the second means comprises a plurality of antenna elements of a first type and wherein the open-ended, substrate-integrated waveguide is one of a plurality of antenna elements of a second type, wherein the first means and the second means are arranged in an array, and wherein the plurality of antenna elements of the first means alternate with the plurality of antenna elements of the first type in the array.

19. The method of claim 15, wherein the first direction and the second direction are substantially orthogonal.

20. The antenna system of claim 1, wherein the open-ended, substrate-integrated waveguide comprises five conductive walls formed in the monolithic substrate.

* * * * *